US010384456B2

(12) United States Patent
Kanbe et al.

(10) Patent No.: US 10,384,456 B2
(45) Date of Patent: Aug. 20, 2019

(54) SYSTEM INCLUDING CARTRIDGE AND ATTACHMENT SECTION AND CAPABLE OF ESTABLISHING RELIABLE ELECTRICAL CONTACT BETWEEN ELECTRICAL INTERFACE OF CARTRIDGE AND CONTACT OF ATTACHMENT SECTION

(71) Applicant: BROTHER KOGYO KABUSHIKI KAISHA, Nagoya-shi, Aichi-ken (JP)

(72) Inventors: Tomohiro Kanbe, Nagoya (JP); Naoya Okazaki, Gifu-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/024,498

(22) Filed: Jun. 29, 2018

(65) Prior Publication Data

US 2018/0304637 A1 Oct. 25, 2018

Related U.S. Application Data

(63) Continuation of application No. PCT/JP2016/000470, filed on Jan. 29, 2016.

(51) Int. Cl.
*B41J 2/175* (2006.01)

(52) U.S. Cl.
CPC ..... *B41J 2/17526* (2013.01); *B41J 2/1752* (2013.01); *B41J 2/1753* (2013.01);
(Continued)

(58) Field of Classification Search
CPC ..... B41J 2/175; B41J 2/17513; B41J 2/1752; B41J 2/17523; B41J 2/17526; B41J 2/1753; B41J 2/17546; B41J 2/17553
See application file for complete search history.

(56) References Cited

U.S. PATENT DOCUMENTS 6,832,830 B2 * 12/2004 Seino ..... B41J 2/17503 347/50
8,833,905 B2 * 9/2014 Kanbe ..... B41J 2/17526 347/49

(Continued)

FOREIGN PATENT DOCUMENTS

| | | | |
|---|---|---|---|
| EP | 2 743 086 | A2 | 6/2014 |
| JP | 2007-15369 | A | 1/2007 |
| JP | 2011-173256 | A | 9/2011 |

OTHER PUBLICATIONS

International Search Report and Written Opinion mailed in related International Patent Application No. PCT/JP2016/000470, dated Oct. 6, 2016.

(Continued)

*Primary Examiner* — Anh T Vo
(74) *Attorney, Agent, or Firm* — Merchant & Gould P.C.

(57) ABSTRACT

A system includes a cartridge and an attachment section to which the cartridge is detachably attachable. The cartridge includes a board supporting portion; a board supported at the board supporting portion; and an electrical interface mounted on the board. The attachment section includes: a contact movable between a contact position and a non-contact position; a first wall; and a second wall movable between a first position allowing the contact to be moved to the contact position and a second position placing the contact at the non-contact position. In a state where the cartridge is completely attached to the attachment section, the cartridge provides a first space receiving the first wall and a second space receiving the second wall at the first position.

9 Claims, 13 Drawing Sheets

(52) U.S. Cl.
CPC ..... *B41J 2/17513* (2013.01); *B41J 2/17523* (2013.01); *B41J 2/17546* (2013.01); *B41J 2/17553* (2013.01)

(56) References Cited

U.S. PATENT DOCUMENTS

| | | | | |
|---|---|---|---|---|
| 2001/0045977 | A1* | 11/2001 | King | B41J 2/1752 347/86 |
| 2006/0290754 | A1 | 12/2006 | Nozawa et al. | |
| 2008/0122904 | A1 | 5/2008 | Tsai et al. | |
| 2011/0205284 | A1 | 8/2011 | Yoshino et al. | |
| 2014/0055535 | A1* | 2/2014 | Takagi | B41J 2/1752 347/86 |
| 2014/0168324 | A1 | 6/2014 | Sasaki | |

OTHER PUBLICATIONS

International Preliminary Report on Patentability issued in related International Patent Application No. PCT/JP2016/000470, dated Aug. 9, 2018.

* cited by examiner

SYSTEM INCLUDING CARTRIDGE AND ATTACHMENT SECTION AND CAPABLE OF ESTABLISHING RELIABLE ELECTRICAL CONTACT BETWEEN ELECTRICAL INTERFACE OF CARTRIDGE AND CONTACT OF ATTACHMENT SECTION

CROSS REFERENCE TO RELATED APPLICATION

This application is a continuation of International Application No. PCT/JP2016/000470 filed Jan. 29, 2016 in Japan Patent Office as a Receiving Office. The entire content of the international application is incorporated herein by reference.

TECHNICAL FIELD

The present disclosure relates to a system that is configured to consume a consumable material accommodated in a cartridge attached to an attachment section.

BACKGROUND

United States Patent Application Publication No. US 2008/0122904 A1 discloses a cartridge that stores ink, and a printer to which the cartridge is attached. The cartridge is provided with electrodes and the printer is provided with contacts. While the cartridge is inserted into and removed from the printer, a block portion of the cartridge contacts a circuit supporting board of the printer, thereby blocking the electrodes from contacting the contacts. When the cartridge has been completely attached to the printer, the block portion is separated from the circuit supporting board, so that the electrodes can contact the contacts. This enables the printer to access, for example, an IC chip provided at the cartridge through the contact between the electrodes and the contacts.

SUMMARY

As circuits become highly integrated, a size of a circuit board becomes smaller and electrodes mounted on the smaller circuit board also become smaller in size. Thus, if the circuit board is not accurately positioned relative to a cartridge, the electrodes mounted on the circuit board may be unable to contact contacts of a printer when the cartridge is mounted in the printer. If such a cartridge with the inaccurately-positioned circuit board were mounted in the printer, the electrodes and the contacts of the printer, which were in contact with each other immediately after the cartridge was mounted in the printer, could be separated from each other sometime later, due to, for example, vibrations of the printer.

In view of the foregoing, it is an object of the disclosure to provide a system in which a reliable electrical contact can be achieved between an electrical interface of a cartridge and an electric contact of an attachment section.

In order to attain above and other object, according to one aspect, the disclosure provides a system including: a cartridge; an attachment section; and a consuming section. The cartridge is configured to accommodate a consumable material. The cartridge is inserted into the attachment section in a first direction to be attached thereto and removed from the attachment section in a second direction opposite to the first direction. The consuming section includes a recording head and is configured to consume the consumable material accommodated in the cartridge upon completion of attachment of the cartridge to the attachment section. The cartridge includes: a board supporting portion; a board; and an electrical interface. The board is supported at the board supporting portion and has a surface facing in a third direction that is orthogonal to the first direction and the second direction. The electrical interface is mounted on the surface of the board. The attachment section includes: a contact; a first wall; a second wall; and a first biasing member. The contact is configured to move between a contact position and a non-contact position separating from the contact position in the third direction. The contact at the contact position overlaps the electrical interface of the cartridge in a state where the cartridge is completely attached to the attachment section. The first wall is positioned offset relative to the contact in the first direction. The first wall has a portion overlapping the board and a part of the board supporting portion of the cartridge as viewed in the first direction in a state where the cartridge is completely attached to the attachment section. The second wall is positioned offset relative to the contact in the second direction. The second wall is configured to move in the third direction and a fourth direction opposite to the third direction. The first biasing member is configured to bias the second wall in the fourth direction. The second wall is configured to move between a first position and a second position. The second wall at the first position has a portion overlapping a trajectory of the board and a part of the board supporting portion of the cartridge that is inserted into and removed from the attachment section. The second wall at the first position allows the contact to be moved to the contact position. The second wall at the second position is positioned offset relative to the trajectory in the third direction. The second wall at the second position places the contact at the non-contact position. In a state where the cartridge is completely attached to the attachment section, the cartridge provides a first space receiving the first wall and a second space receiving the second wall at the first position. The first space is formed in a region offset relative to the board and a part of the board supporting portion in the first direction. The second space is formed in a region offset relative to the board and a part of the board supporting portion in the second direction.

Here, "the cartridge is completely attached to the attachment section" implies a state where the consuming section can consume consumable material accommodated in the cartridge, for example. Further, in the course of insertion and removal of the cartridge relative to the attachment section, either the board or the board supporting portion may contact the second wall, or any other component of the cartridge may contact the second wall.

BRIEF DESCRIPTION OF THE DRAWINGS

The particular features and advantages of the embodiment(s) as well as other objects will become apparent from the following description taken in connection with the accompanying drawings, in which:

FIGS. 5A through 5C are perspective views of a contact unit 125, in which FIG. 5A illustrates a state in which a moving wall 127 is removed from a body portion 126; FIG.

5B illustrates a state in which the moving wall 127 is positioned at a first position; and FIG. 5C illustrates a state in which the moving wall 127 is positioned at a second position;

FIGS. 11A and 11B are cross-sectional views of the ink cartridge 30 and the cartridge attachment section 110 illustrating a state where the ink cartridge 30 at which an IC board 85 is displaced relative to a board supporting portion 84 is attached to the cartridge attachment section 110, in which FIG. 11A illustrates a state where the IC board 85 is displaced in an insertion direction 51 relative to the board supporting portion 84; and FIG. 11B illustrates a state where the IC board 85 is displaced in a removal direction 52 relative to the board supporting portion 84;

FIG. 12A through 12C are schematic views of the IC board 85, in which FIG. 12A is a schematic perspective view of the IC board 85 as viewed from an upper side thereof; FIG. 12B is a schematic cross-sectional view of the IC board 85 taken along a line A-A in FIG. 12A; and FIG. 12C is a schematic perspective view of the IC board 85 as viewed from a lower side thereof;

DETAILED DESCRIPTION

Figure 1:
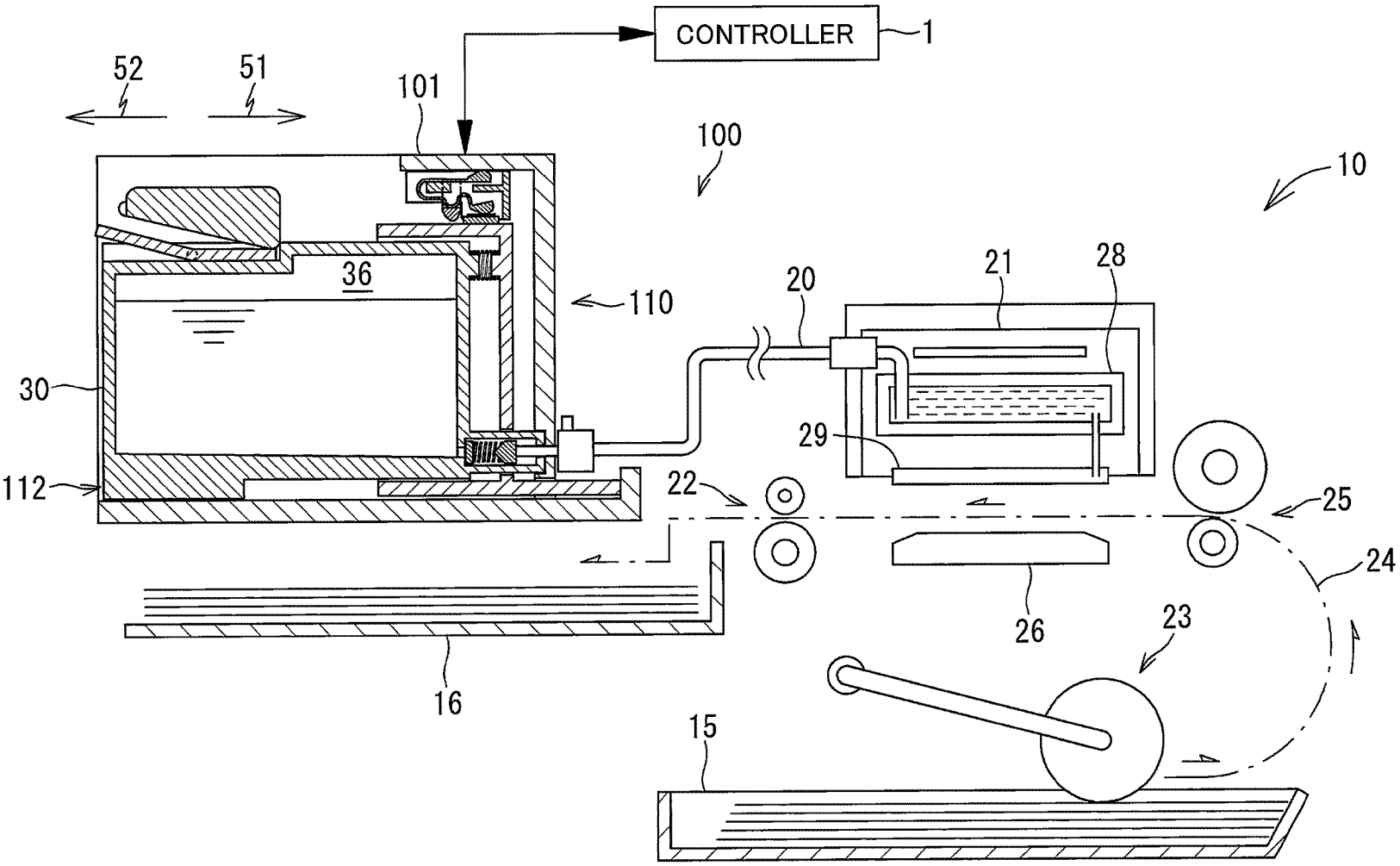
FIG. 1 is a schematic cross-sectional view schematically illustrating an internal structure of a printer 10 according to one embodiment.

A printer 10 according to one embodiment of the disclosure will be described with reference to FIGS. 1 through 10, wherein like parts and components are designated by the same reference numerals to avoid duplicating description.

In the following description, a direction in which an ink cartridge 30 is inserted into and attached to a cartridge attachment section 110 is defined as an insertion direction 51 (an example of a first direction). A direction opposite to the insertion direction 51, i.e., a direction in which the ink cartridge 30 is removed from the cartridge attachment section 110 is defined as a removal direction 52 (an example of a second direction). The insertion direction 51 and the removal direction 52 are parallel to a horizontal direction in the present embodiment, but the insertion direction 51 and the removal direction 52 may not necessarily be parallel to the horizontal direction. The insertion direction 51 may be a horizontal frontward direction, while the removal direction 52 may be a horizontal rearward direction.

A direction orthogonal to the insertion direction 51 and the removal direction 52 is defined as an upward direction 54 (an example of a third direction). A direction opposite to the upward direction 54 is defined as a downward direction 53 (an example of a fourth direction). In the present embodiment, the upward direction 54 as an example of the third direction is a vertically upward direction, while the downward direction 53 as an example of the fourth direction is a vertically downward direction. However, the third direction and the fourth direction may not necessarily be the vertical direction.

Further, directions orthogonal to the insertion direction 51 and the downward direction 53 are defined as a rightward direction 55 (an example of a fifth direction) and a leftward direction 56 (an example of a sixth direction). More specifically, when the ink cartridge 30 has been completely attached to the cartridge attachment section 110, that is, when the ink cartridge 30 is in an attached state (usable state), the direction orienting toward the right is defined as the rightward direction 55, while the direction orienting toward the left is defined as the leftward direction 56 when the ink cartridge 30 is viewed in the insertion direction 51. In the present embodiment, the rightward direction 55 as an example of the fifth direction and the leftward direction 56 as an example of the sixth direction are parallel to the horizontal direction. However, the fifth direction and the sixth direction may not necessarily be the horizontal direction.

<Overall Structure of Printer 10>

As illustrated in FIG. 1, the printer 10 (an example of a system) is configured to selectively discharge ink droplets onto recording sheets to record images thereon based on an inkjet recording scheme. The printer 10 includes an ink supply device 100.

The ink supply device 100 is configured to supply ink to a recording head 21. Referring to FIG. 1, the ink supply device 100 includes the cartridge attachment section 110 (an example of an attachment section), four ink cartridges 30 (an example of a cartridge), the recording head 21 (an example of a consuming section), and a controller 1 configured to control overall operations of the printer 10. The ink cartridges 30 are attachable to and detachable from the cartridge attachment section 110. The cartridge attachment section 110 has one surface in which an opening 112 is formed. The ink cartridges 30 are inserted into the cartridge attachment section 110 or removed from the cartridge attachment section 110 through the opening 112. Four ink cartridges 30 corresponding to respective colors of cyan, magenta, yellow, and black can be accommodated in the ink supply device 100. Hereinafter, for an explanatory purpose, in the following description and in the drawings, only one ink cartridge 30 is assumed to be attached to the cartridge attachment section 110, wherever necessary. Incidentally, FIG. 1 illustrates a state where the ink cartridge 30 is attached to the cartridge attachment section 110.

The ink cartridge 30 stores ink (an example of a consumable material) that can be used in the printer 10. In other words, the ink cartridge 30 accommodates ink therein. When the ink cartridge 30 is attached to the cartridge attachment section 110, the ink cartridge 30 and the recording head 21 are connected by a corresponding ink tube 20. The recording head 21 includes four sub-tanks 28 corresponding to the four ink cartridges 30. Each sub-tank 28 is configured to temporarily store the ink supplied from the corresponding ink cartridge 30 through the corresponding ink tube 20. The recording head 21 is configured to selectively discharge the ink supplied from the respective sub-tanks 28 through nozzles 29 according to an inkjet recording scheme.

The printer 10 includes a sheet feeding tray 15, a sheet feeding roller 23, a pair of conveying rollers 25, a platen 26, a pair of discharge rollers 22, and a sheet discharge tray 16. A recording sheet is fed from the sheet feeding tray 15 to a conveying path 24 by the sheet feeding roller 23, and is then conveyed onto the platen 26 by the pair of conveying rollers 25. The recording head 21 selectively discharges ink onto the recording sheet that passes over the platen 26 to form an image on the recording sheet. Also, in this way, the ink stored in the ink cartridge 30 completely attached to the cartridge attachment section 110 is consumed by the recording head 21. The recording sheet having passed through the platen 26 is finally discharged by the pair of discharge rollers 22 onto the sheet discharge tray 16 positioned most downstream in the conveying path 24.

<Ink Cartridge 30>

Figure 2:
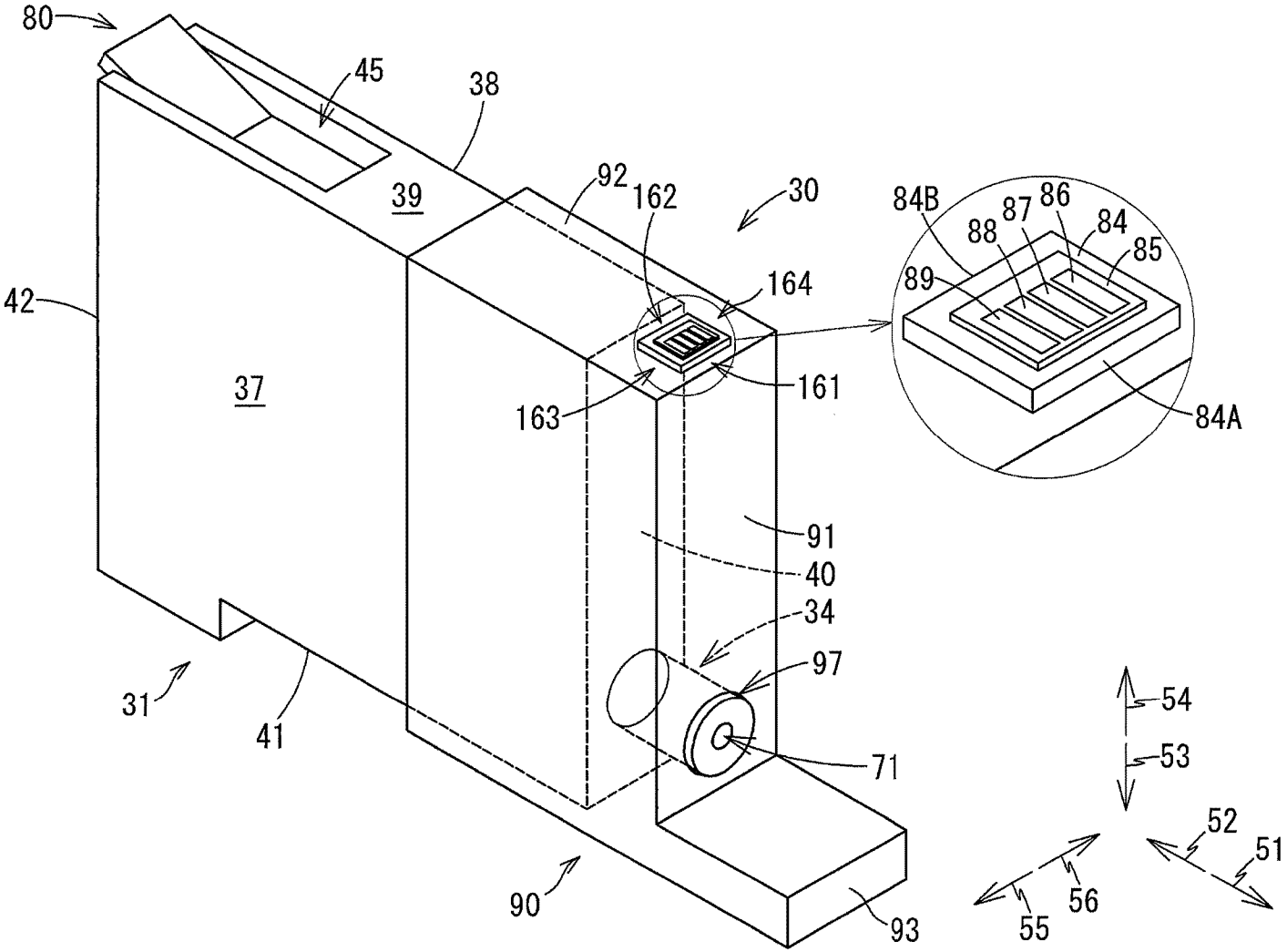
FIG. 2 is a perspective view illustrating an external configuration of an ink cartridge 30.
Figure 3:
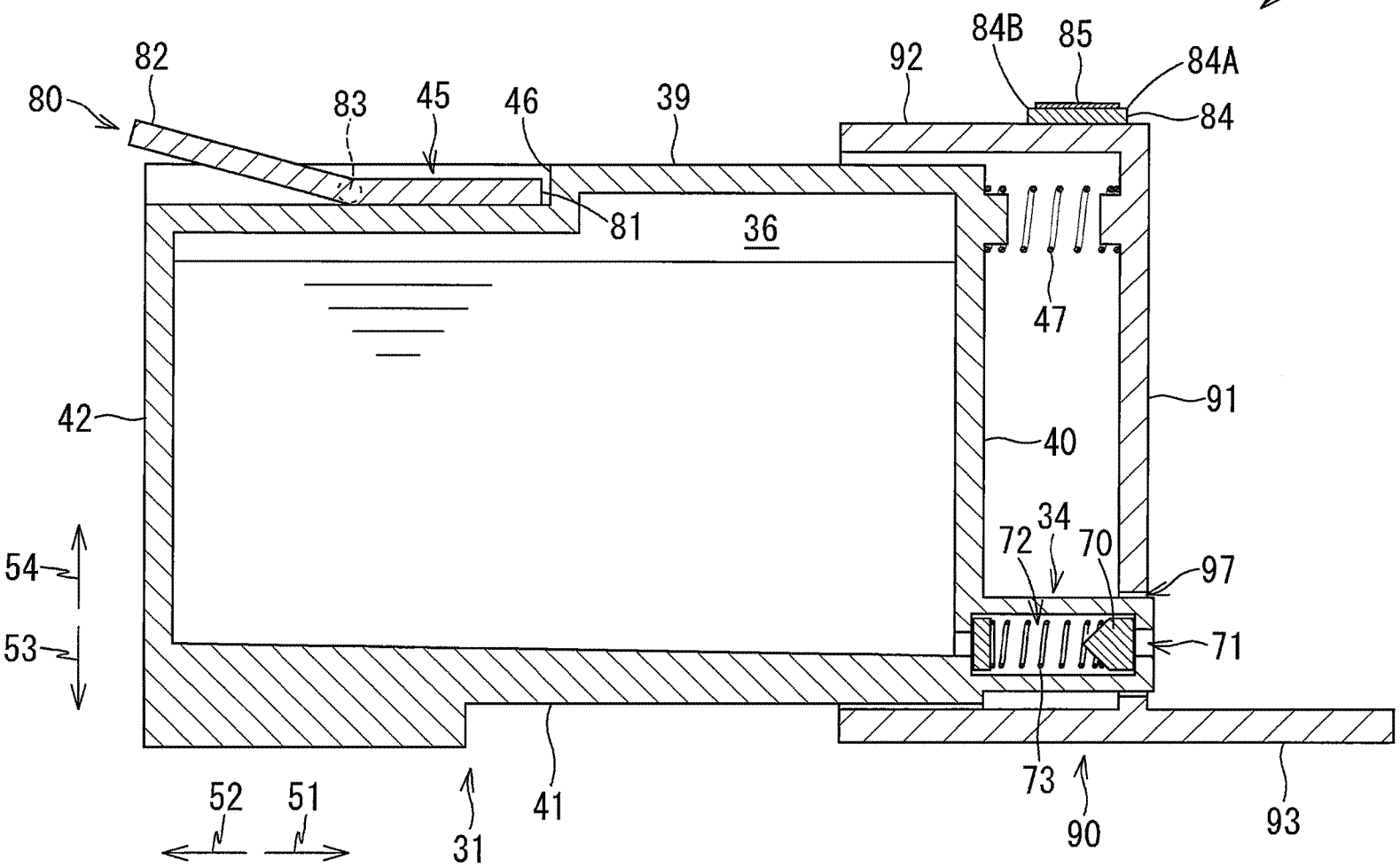
FIG. 3 is a cross-sectional view illustrating an internal configuration of the ink cartridge 30.

The ink cartridge 30 shown in FIGS. 2 and 3 is a container for storing ink. The ink cartridge 30 has a space formed therein that serves as an ink chamber 36 for storing ink. The ink chamber 36 of the present embodiment is formed by a housing constituting a main body 31 of the ink cartridge 30. However, the ink chamber 36 may be formed by an inner frame that is a separate member from the housing of the main body 31 defining an outer shape of the ink cartridge 30, for example.

When the ink cartridge 30 is attached to the ink supply device 100, the ink cartridge 30 is in a posture shown in FIGS. 2 and 3. This posture of the ink cartridge 30 shown in FIGS. 2 and 3 is referred to as an attached posture. The ink cartridge 30 includes a front wall 91, a rear wall 42, a top wall 39, 92, a bottom wall 41, a side wall 37, and a side wall 38, as will be described later. In the attached posture illustrated in FIGS. 2 and 3, a direction from the rear wall 42 toward the front wall 91 is coincident with the insertion direction 51, a direction from the front wall 91 toward the rear wall 42 is coincident with the removal direction 52, a direction from the top wall 39, 92 toward the bottom wall 41 is coincident with the downward direction 53, a direction from the bottom wall 41 toward the top wall 39, 92 is coincident with the upward direction 54, a direction from the side wall 38 toward the side wall 37 is coincident with the rightward direction 55, and a direction from the side wall 37 toward the side wall 38 is coincident with the leftward direction 56. When the ink cartridge 30 is being inserted into and attached to the cartridge attachment section 110, an outer surface of the front wall 91 faces in the insertion direction 51, an outer surface of the rear wall 42 faces in the removal direction 52, an outer surface of the bottom wall 41 faces in the downward direction 53, an outer surface of the top wall 39, 92 faces in the upward direction 54, an outer surface of the side wall 37 faces in the rightward direction 55, and an outer surface of the side wall 38 faces in the leftward direction 56.

The ink cartridge 30 includes the main body 31 and a cover 90 (an example of a movable member). The main body 31 has a substantially flat rectangular parallelepiped shape. The main body 31 may have other three-dimensional shape configured of flat or curved surfaces. The cover 90 is assembled to the main body 31 to form an outer shape of the ink cartridge 30. That is, the main body 31 and the cover 90 in combination (as an example of a casing) constitute an outer shape of the ink cartridge 30. The ink cartridge 30 has a shape that appears flattened in the rightward direction 55 and the leftward direction 56 so that the dimension in the upward direction 54 and the downward direction 53 and the dimension in the insertion direction 51 and the removal direction 52 are larger than the dimension in the rightward direction 55 and the leftward direction 56.

<Main Casing 31>

As illustrated in FIGS. 2 and 3, the main body 31 includes a front wall 40, the rear wall 42, the side wall 37, the side wall 38, the top wall 39, and the bottom wall 41.

The front wall 40 is a wall that faces in the insertion direction 51 when the ink cartridge 30 is inserted into and attached to the cartridge attachment section 110. The rear wall 42 is a wall that faces in the removal direction 52 when the ink cartridge 30 is inserted into and attached to the cartridge attachment section 110. The front wall 40 and the rear wall 42 are disposed so as to be spaced apart from each other in the insertion direction 51 and the removal direction 52.

The side wall 37 (right side wall 37) connects a right end of the front wall 40 and a right end of the rear wall 42. The side wall 38 (left side wall 38) connects a left end of the front wall 40 and a left end of the rear wall 42. The top wall 39 connects an upper end of the front wall 40 and an upper end of the rear wall 42. The bottom wall 41 connects a lower end of the front wall 40 and a lower end of the rear wall 42.

The ink chamber 36 is defined by the front wall 40, the rear wall 42, the side wall 37, the side wall 38, the top wall 39, and the bottom wall 41. That is, the main body 31 accommodates ink in the ink chamber 36.

On a lower end portion of the front wall 40, an ink supply portion 34 is provided. The ink supply portion 34 has a cylindrical outer shape and protrudes in the insertion direction 51 from the front wall 40. The ink supply portion 34 has a protruding end in which an ink supply opening 71 is formed. The ink supply opening 71 of the ink supply portion 34 can be exposed to the outside of the cover 90 through an opening 97 of the cover 90.

The ink supply portion 34 defines an internal space serving as an ink passage 72. The ink passage 72 extends in the insertion direction 51 and the removal direction 52, and connects between the ink supply opening 71 and the ink chamber 36. The ink passage 72 has an open end in communication with the outside of the main body 31 through the ink supply opening 71. The ink passage 72 extends in the removal direction 52 from the ink supply opening 71 to be in fluid communication with the ink chamber 36 (the inside of the main body 31). An ink supply valve 70 and a coil spring 73 are disposed within the ink passage 72. The coil spring 73 applies a biasing force to the ink supply valve 70 to bias the ink supply valve 70 toward the ink supply opening 71. Thus, the ink supply opening 71 can be opened and closed by the ink supply valve 70 due to the biasing force of the coil spring 73. When the ink cartridge 30 is attached to the cartridge attachment section 110, an ink needle 117 (see FIG. 4) provided at the cartridge attachment section 110 is inserted into the ink supply opening 71, thereby moving the ink supply valve 70 away from the ink supply opening 71 against the biasing force of the coil spring 73. In this way, the ink in the ink chamber 36 is configured to flow, through the ink passage 72, into the ink needle 117 provided at the cartridge attachment section 110.

The ink supply opening 71 may not necessarily be opened and closed by the ink supply valve 70. As an alternative, for example, the ink supply opening 71 may be covered by a film. In this case, when the ink cartridge 30 is attached to the cartridge attachment section 110, the ink needle 117 pierces through the film to open the ink supply opening 71. Further, although not illustrated in the present embodiment, an air communication port may be formed in the main body 31 to bring the ink chamber 36 maintained in a negative pressure into an ambient pressure.

A locking portion 45 is provided at the top wall 39 of the main body 31. The locking portion 45 extends from a substantially center region of the top wall 39 in the insertion direction 51 and the removal direction 52 to the rear wall 42. The locking portion 45 has a groove formed in the top wall 39 and extending in the insertion direction 51 and the removal direction 52. The groove has an end surface in the insertion direction 51 serving as a locking surface 46 of the locking portion 45. The locking surface 46 faces in the removal direction 52 of the ink cartridge 30. When the ink cartridge 30 is attached to the cartridge attachment section 110, an engagement member 145 (an example of a lock portion, see FIG. 4) of the cartridge attachment section 110, which will be described later, engages with the locking surface 46. The locking surface 46 is adapted to receive an external force in a direction opposite to the biasing force that pushes the ink cartridge 30 in the removal direction 52. In other words, in the present embodiment, the locking surface 46 can receive a force applied from the engagement member 145. The groove of the locking portion 45 has another end in the removal direction 52 (rear end) that is open to the outside of the main body 31.

A pivot member 80 is provided at the locking portion 45 of the main body 31. The pivot member 80 has a bent flat plate-like shape, for example, and is elongated in the insertion direction 51 and the removal direction 52. The pivot member 80 has a bent portion at which a shaft 83 is provided. The shaft 83 extends in the rightward direction 55 and the leftward direction 56 to allow the pivot member 80 to pivotally move about the shaft 83. The pivot member 80 has a tip end portion 81 and a rear end portion 82. The tip end portion 81 extends in the insertion direction 51 from the shaft 83. The rear end portion 82 extends in the removal direction 52 from the shaft 83.

When the pivot member 80 pivotally moves until the tip end portion 81 reaches its uppermost position, the tip end portion 81 protrudes above the top wall 39 of the main body 31. When the tip end portion 81 of the pivot member 80 is pressed downward, the pivot member 80 is caused to pivotally move clockwise in FIG. 3. When the pivot member 80 has pivotally moved clockwise to its full extent, the tip end portion 81 is located near a lower end of the locking surface 46. The pivot member 80 may be integral with the main body 31. Still alternatively, the pivot member 80 may be biased clockwise by a coil spring, or may be configured to pivotally move clockwise or counterclockwise by its own weight.

<Cover 90>

As illustrated in FIGS. 2 and 3, the cover 90 has such a shape that covers at least a portion of outer surfaces constituting the main body 31. For example, the cover 90 has a flattened container-like shape that can cover the entire front wall 40, a portion of the side wall 37, a portion of the side wall 38, a portion of the top wall 39, and a portion of the bottom wall 41 of the main body 31 from the outer sides thereof. The cover 90 has such a width (the length in the rightward direction 55 and the leftward direction 56) and a height (the length in the upward direction 54 and the downward direction 53) that can cover the entire front wall 40 of the main body 31 and has such a depth (the length in the insertion direction 51 and the removal direction 52) that can cover a portion of each of the side wall 37, the side wall 38, the top wall 39, and the bottom wall 41. That is, the cover 90 has a box-like shape that has a width larger than the width of the main body 31, a height larger than the height of the main body 31, and a depth smaller than the depth of the main body 31. Moreover, the cover 90 has an opening that faces the front wall 91 in the insertion direction 51 and the removal direction 52. The main body 31 can be inserted into the cover 90 through the opening.

Although not illustrated in detail in the respective drawings, the cover 90 can slidingly move in the insertion direction 51 and the removal direction 52 relative to the main body 31 when assembled to the main body 31. Such sliding movement of the cover 90 relative to the main body 31 can be realized, for example, by providing an engagement claw at one of the main body 31 and the cover 90 and forming an elongated hole extending in the insertion direction 51 and the removal direction 52 in the other of the main body 31 and the cover 90, and inserting the engagement claw into the elongated hole. When the cover 90 slidingly moves relative to the main body 31 and the engagement claw contacts an end in the insertion direction 51 or the removal direction 52 of the elongated hole, further sliding movement of the cover 90 is restricted.

As illustrated in FIG. 3, a coil spring 47 (an example of a second biasing member) is provided at a position between the front wall 40 of the main body 31 and the cover 90. The coil spring 47 can be resiliently compressed in the insertion direction 51 and the removal direction 52.

The coil spring 47 applies a biasing force to the front wall 91 of the cover 90. Due to the biasing force of the coil spring 47, the cover 90 is positioned at a remote position when no external force is applied to the front wall 91 (see FIG. 3). When the cover 90 is positioned at the remote position, the front wall 91 of the cover 90 is positioned farthest in the insertion direction 51 from the front wall 40 of the main body 31. More specifically, when the cover 90 is positioned at the remote position, the front wall 91 of the cover 90 facing the front wall 40 of the main body 31 is displaced in the insertion direction 51 from the most part of the ink supply portion 34. Thus, the most part of the ink supply portion 34 is received in the cover 90.

When an external force is applied to one of the main body 31 and the cover 90 in a direction of moving the one of the main body 31 and the cover 90 closer to the other of the main body 31 and the cover 90, the coil spring 47 is resiliently compressed. At this time, the cover 90 slidingly moves so that the front wall 91 of the cover 90 moves toward the front wall 40 of the main body 31. As a result, the cover 90 is positioned at a proximity position (see FIG. 9). When the cover 90 is at the proximity position, the front wall 91 of the cover 90 is positioned closest to the front wall 40 of the main body 31. When the cover 90 is positioned at a position other than the remote position, the compressed coil spring 47 biases the cover 90 in the insertion direction 51 to move the cover 90 away from the main body 31.

In this way, the cover 90 can move in the insertion direction 51 and the removal direction 52 relative to the main body 31 in accordance with expansion and compression of the coil spring 47.

The front wall 91 of the cover 90 is formed with the opening 97 at its lower portion. The opening 97 penetrates the front wall 91 in the insertion direction 51 and the removal direction 52. The opening 97 serves as a passage for exposing the ink supply portion 34 of the main body 31 to the outside when the cover 90 moves to the proximity position. Thus, the opening 97 is formed such that the position, dimensions, and shape thereof correspond to those of the ink supply portion 34 of the main body 31.

The front wall 91 of the cover 90 has a projection 93 at its lower end. The projection 93 has a width the same as that of the front wall 91. The projection 93 protrudes in the insertion direction 51 from the front wall 91. The projection 93 contacts a contacted portion 94 (see FIG. 4) of a case 101 when the ink cartridge 30 is inserted into and attached to the cartridge attachment section 110. When the main body 31 is further moves in the insertion direction 51 in a state where the projection 93 maintains contact with the contacted portion 94, the cover 90 moves relative to the main body 31. Thus, a protruding length of the projection 93 is set so as to correspond to a moving distance of the cover 90.

A board supporting portion 84 is provided on an upper surface of the top wall 92 of the cover 90 facing the top wall 39 of the main body 31. The board supporting portion 84 has a substantially rectangular parallelepiped shape. The board supporting portion 84 is mounted on the upper surface of the top wall 92. The board supporting portion 84 protrudes in the upward direction 54 from the upper surface of the top wall 92. The board supporting portion 84 may be formed as a separate member from the top wall 92 or may be integrally formed with the top wall 92. Still alternatively, the board supporting portion 84 may have a shape other than the rectangular parallelepiped shape.

The board supporting portion 84 has an upper surface on which an IC board 85 (an example of an IC chip and a board) is attached by a well-known method, such as adhesion. That is, the board supporting portion 84 supports the IC board 85. The IC board 85 has a length in the insertion direction 51 and the removal direction 52 equal to or smaller than a length in the insertion direction 51 and the removal direction 52 of the board supporting portion 84. In the present embodiment, the length in the insertion direction 51 and the removal direction 52 of the IC board 85 is smaller than the length in the insertion direction 51 and the removal direction 52 of the board supporting portion 84. The board supporting portion 84 has a first end 84A and a second end 84B. The first end 84A is extended in the insertion direction 51 further than the IC board 85 supported on the board supporting portion 84. The second end 84B is extended in the removal direction 52 further than the IC board 85 supported on the board supporting portion 84.

The IC board 85 has an upper surface (i.e. a surface facing in the upward direction 54) on which four electrodes 86, 87, 88, and 89 (examples of an electrical interface) are formed. The respective electrodes 86, 87, 88, and 89 are provided on the upper surface of the IC board 85 so as to extend in the insertion direction 51 and the removal direction 52. The respective electrodes 86, 87, 88, and 89 are arranged in separation from one another in the rightward direction 55 and the leftward direction 56. The electrodes 86, 87, 88, and 89 are a clock electrode, a data electrode, a power supply voltage electrode, and a ground electrode, for example. An IC 85A (an example of an integrated circuit) is also mounted on the IC board 85, as illustrated in FIG. 12B. The IC 85A is a semiconductor integrated circuit and is electrically connected to the respective electrodes 86, 87, 88, and 89. Specifically, the IC 85A is mounted on a lower surface of the IC board 85 at its substantially center region in the insertion direction 51 and the removal direction 52 and in the rightward direction 55 and the leftward direction 56. The IC 85A is covered by a protection layer 85B made of an electrically-insulating material. The protection layer 85B has a substantially circular shape in a bottom view and protrudes in the downward direction 53 from the lower surface of the IC board 85, as illustrated in FIGS. 12B and 12C. The IC board 85 is attached to the board supporting portion 84 such that the protection layer 85B by which the IC 85A is covered is accommodated in a recessed portion (not illustrated) formed in the board supporting portion 84. The IC 85A stores data indicative of information on the ink cartridge 30 (for example, a lot number and the date of production) as well as information on ink (for example, a color of ink). External access to the IC 85A enables the data stored in the IC 85A to be retrieved therefrom. Incidentally, the number of electrodes is not limited to four, but less than or more than four electrodes may be provided on the IC board 85. Note that the IC 85A and the protection layer 85B are not illustrated in FIGS. 3, 6, 7, 8, 9 and 11 for the sake of simplicity.

The board supporting portion 84 is arranged so as to protrude from the top wall 92. In a state where the ink cartridge 30 is completely attached to the cartridge attachment section 110, the cover 90 of the ink cartridge 30 and the cartridge attachment section 110 define a space therebetween near the board supporting portion 84 and the IC board 85. This space will be described in detail below.

Specifically, four spaces, namely, a first space 161, a second space 162, a third space 163, and a fourth space 164, are defined in the vicinity of the board supporting portion 84 and the IC board 85, as illustrated in FIG. 2.

The first space 161 is formed in a region offset in the insertion direction 51 relative to the board supporting portion 84 and the IC board 85. In other words, the first space 161 is formed in a region downstream in the insertion direction 51 relative to the board supporting portion 84 and the IC board 85. That is, the first space 161 is formed in a region forward relative to the board supporting portion 84 and the IC board 85. Although the cartridge attachment section 110 is not illustrated in FIG. 2, the first space 161 is defined by the top wall 92, surfaces of the board supporting portion 84 and the IC board 85 facing in the insertion direction 51, a top surface 104 (see FIGS. 4 and 10) of the cartridge attachment section 110, and an end surface 102 (see FIGS. 4 and 10) of the cartridge attachment section 110. The first space 161 is a space large enough for receiving a front wall 155 of a contact unit 125 (described later) therein. In a state where the ink cartridge 30 is completely attached to the cartridge attachment section 110, the front wall 155 is disposed in the first space 161. That is, the first space 161 is a space for accommodating the front wall 155 therein.

The second space 162 is formed in a region offset in the removal direction 52 relative to the board supporting portion 84 and the IC board 85. In other words, the second space 162 is formed in a region downstream in the removal direction 52 relative to the board supporting portion 84 and the IC board 85. That is, the second space 162 is formed in a region rearward relative to the board supporting portion 84 and the IC board 85. Although the cartridge attachment section 110 is not illustrated in FIG. 2, the second space 162 is defined by the top wall 92, surfaces of the board supporting portion 84 and the IC board 85 facing in the removal direction 52, and the top surface 104 of the cartridge attachment section 110. The second space 162 is a space large enough for receiving a moving wall 127 of the contact unit 125 (described later) therein. In a state where the ink cartridge 30 is completely attached to the cartridge attachment section 110, the moving wall 127 is disposed in the second space 162. That is, the second space 162 is a space for accommodating the moving wall 127 therein.

The first space 161 may be formed in a region offset in the insertion direction 51 relative to the IC board 85 and a portion of the board supporting portion 84. Here, "a portion of the board supporting portion 84" means a portion of the board supporting portion 84 overlapping the front wall 155 when viewed in the insertion direction 51. Further, the second space 162 may be formed in a region offset in the removal direction 52 relative to the IC board 85 and a portion of the board supporting portion 84. Here, "a portion of the board supporting portion 84" means a portion of the board supporting portion 84 overlapping the moving wall 127 when viewed in the removal direction 52.

Figure 13:
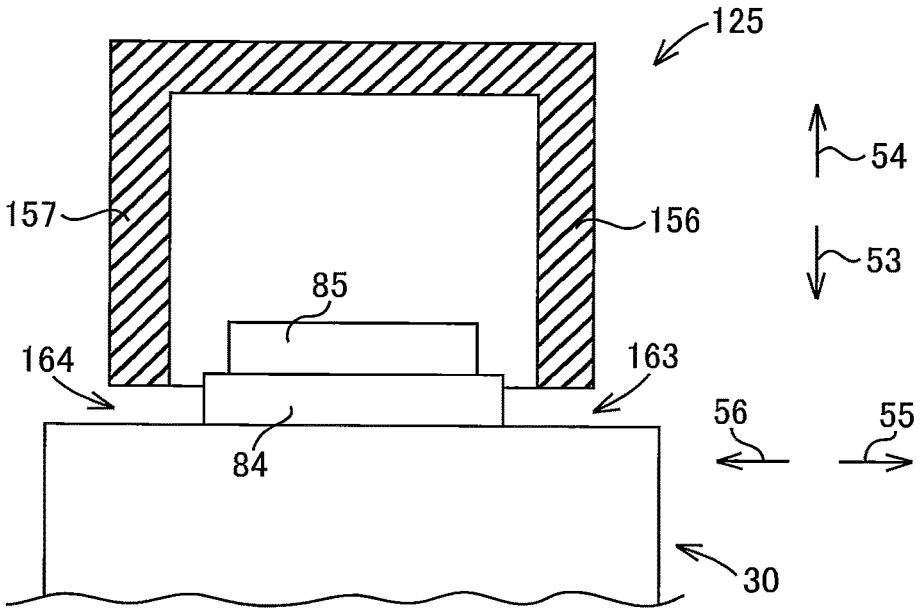
FIG. 13 is a partial schematic cross-sectional views of the ink cartridge 30 and the contact unit 125 of the cartridge attachment section 110 illustrating a state where the ink cartridge 30 is completely attached to the cartridge attachment section 110 as viewed in the insertion direction 51, in which a flexible member 128 is omitted in the contact unit 125 for the sake of simplicity.

The third space 163 is formed in a region offset in the rightward direction 55 relative to the IC board 85. In other words, the third space 163 is formed in a region positioned rightward of the IC board 85. That is, the third space 163 is formed in a region downstream in the rightward direction 55 relative to the IC board 85. Although the cartridge attachment section 110 is not illustrated in FIG. 2, the third space 163 is defined by the top wall 92, right surfaces of the board supporting portion 84 and the IC board 85, the top surface 104 of the cartridge attachment section 110, and a right side surface 105 (see FIG. 10) of the cartridge attachment section 110. The third space 163 is a space large enough for receiving a right side wall 156 of the contact unit 125 (described later) therein. In a state where the ink cartridge 30 is completely attached to the cartridge attachment section 110, the right side wall 156 is disposed in the third space 163 (see FIG. 13). That is, the third space 163 is a space for accommodating the right side wall 156 therein.

The fourth space 164 is formed in a region offset in the leftward direction 56 relative to the IC board 85. In other words, the fourth space 164 is formed in a region positioned leftward of the IC board 85. That is, the fourth space 164 is formed in a region downstream in the leftward direction 56 relative to the IC board 85. Although the cartridge attachment section 110 is not illustrated in FIG. 2, the fourth space 164 is defined by the top wall 92, left surfaces of the board supporting portion 84 and the IC board 85, the top surface 104 of the cartridge attachment section 110 and a left side surface 106 (see FIGS. 4 and 10) of the cartridge attachment section 110. The fourth space 164 is a space large enough for receiving a left side wall 157 of the contact unit 125 (described later) therein. In a state where the ink cartridge 30 is completely attached to the cartridge attachment section 110, the left side wall 157 is disposed in the fourth space 164 (see FIG. 13). That is, the fourth space 164 is a space that for accommodating the left side wall 157 therein.

<Cartridge Attachment Section 110>

Figure 4:
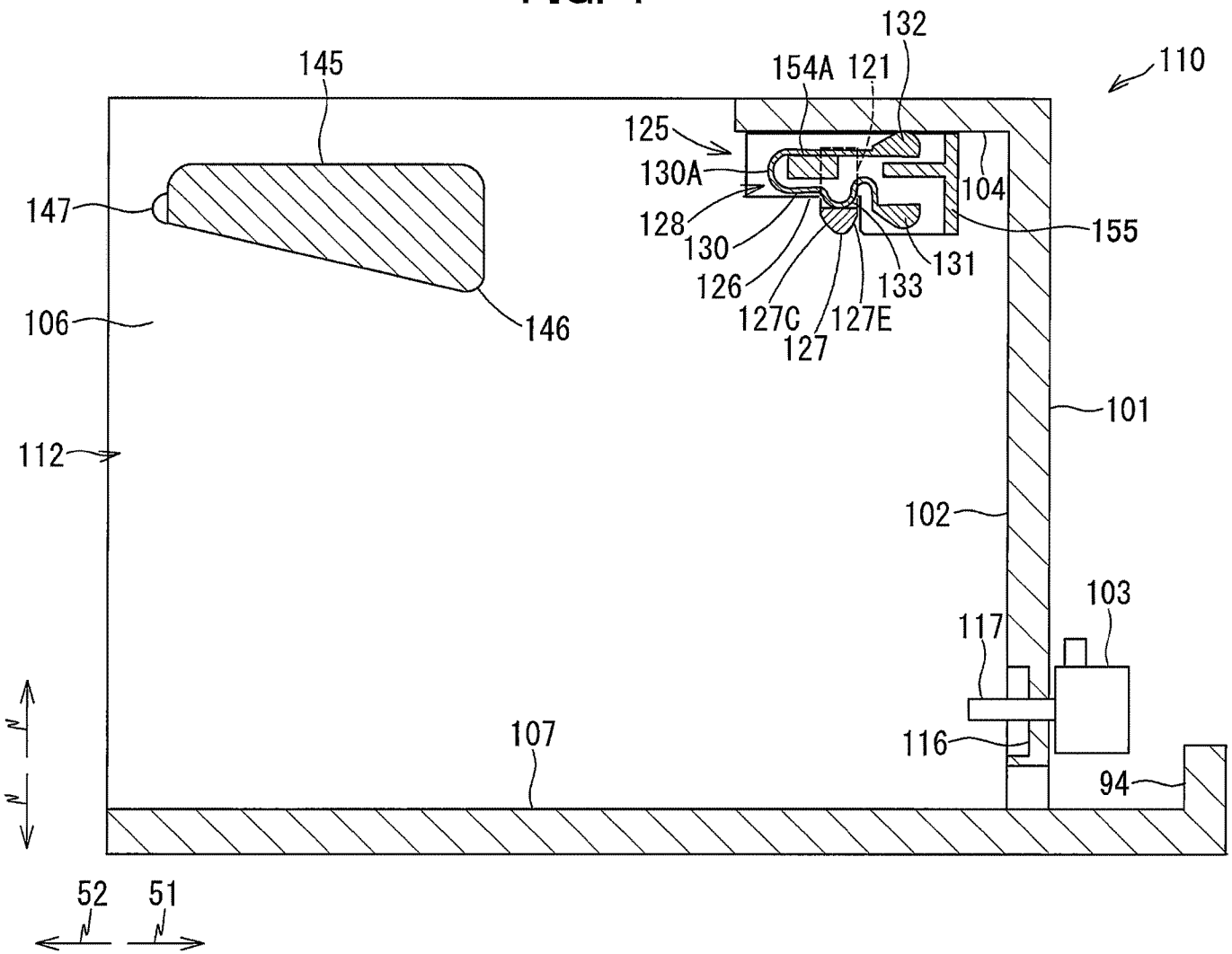
FIG. 4 is a cross-sectional view illustrating a configuration of a cartridge attachment section 110.
Figure 10:
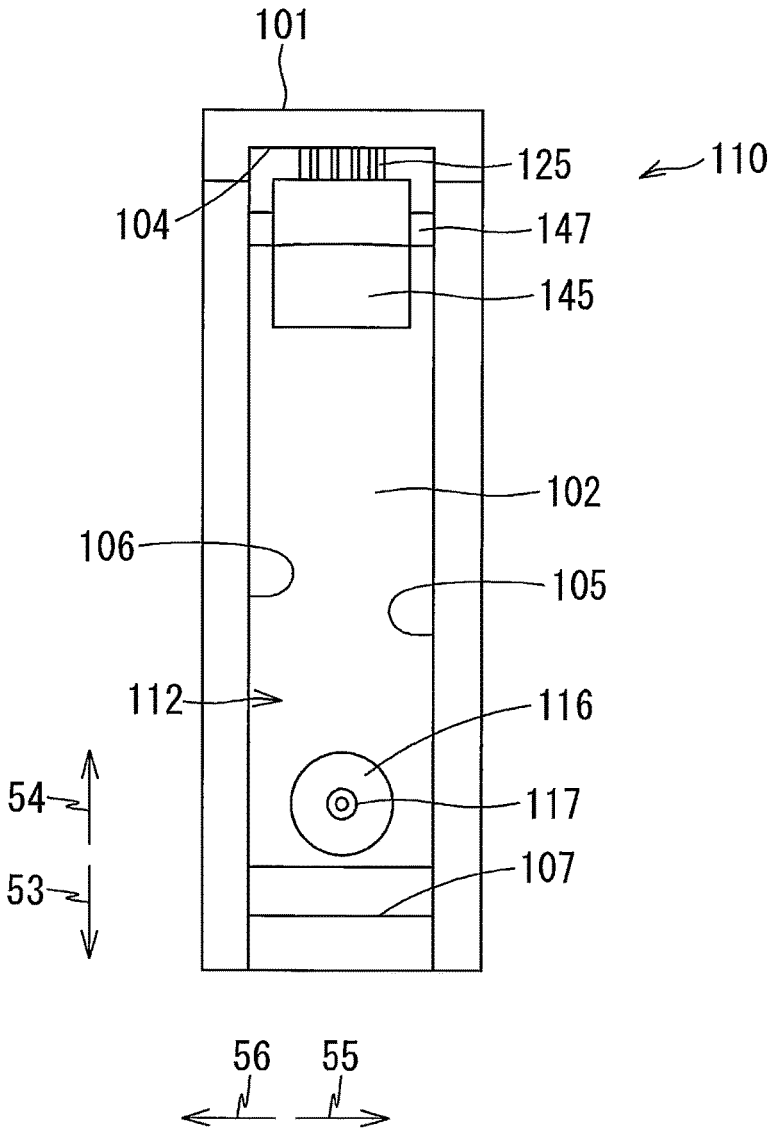
FIG. 10 is a front view illustrating an external configuration of the cartridge attachment section 110.

As illustrated in FIGS. 4 and 10, the case 101 that constitutes a housing of the cartridge attachment section 110 has the opening 112. Through the opening 112, an internal space of the case 101 is exposed to a surface of the printer 10 that a user faces when using the printer 10. The ink cartridge 30 is inserted into and removed from the case 101 through the opening 112. The case 101 can accommodate therein four ink cartridges 30 corresponding to the respective colors of cyan, magenta, yellow, and black. However, for an explanatory purpose, FIGS. 4 and 10 illustrate a space of the case 101 in which only one ink cartridge 30 can be accommodated. The internal space of the case 101 is defined by the end surface 102 facing the opening 112 in the insertion direction 51 and the removal direction 52, the top surface 104, the right side surface 105, the left side surface 106, and a bottom surface 107. In the following description, a connecting portion 103, the contacted portion 94, the engagement member 145, and the contact unit 125 are provided for each of the four ink cartridges 30 accommodated in the case 101. That is, in the present embodiment, four connecting portions 103, four contacted portions 94, four engagement members 145, and four contact units 125 are provided at the case 101. The four connecting portions 103 are arranged in the rightward direction 55 and the leftward direction 56 and have a configuration the same as one another. Similarly, the four contacted portions 94 are arranged in the rightward direction 55 and the leftward direction 56 and have a configuration the same as one another. The four engagement members 145 are also arranged in the rightward direction 55 and the leftward direction 56 and have a configuration the same as one another. The four contact units 125 are also arranged in the rightward direction 55 and the leftward direction 56 and have a configuration the same as one another. Thus, in the following description, for simplifying the explanation, detailed description will be given only for one of the four connecting portions 103, one of the four contacted portions 94, one of the four engagement members 145, and one of the four contact units 125. Description for the remaining three connecting portions 103, the remaining three contacted portions 94, the remaining three engagement members 145, and the remaining three contact units 125 will be omitted.

The connecting portion 103 is provided at a lower portion of the end surface 102. The connecting portion 103 is disposed on the end surface 102 at a position corresponding to the ink supply portion 34 of the ink cartridge 30 attached to the case 101.

The connecting portion 103 has the ink needle 117 and a retention groove 116. The ink needle 117 is formed of resin having a tubular configuration. The ink needle 117 penetrates the case 101 in the insertion direction 51 and the removal direction 52 to connect the inside of the case 101 and the outside of the case 101. The ink needle 117 has an outer end that is positioned outside the case 101, and the outer end is connected to the ink tube 20. The ink tube 20 connected to the ink needle 117 extends to the recording head 21 of the printer 10 to allow ink to be supplied to the recording head 21. The ink tube 20 is not illustrated in FIG. 4.

Figure 9:
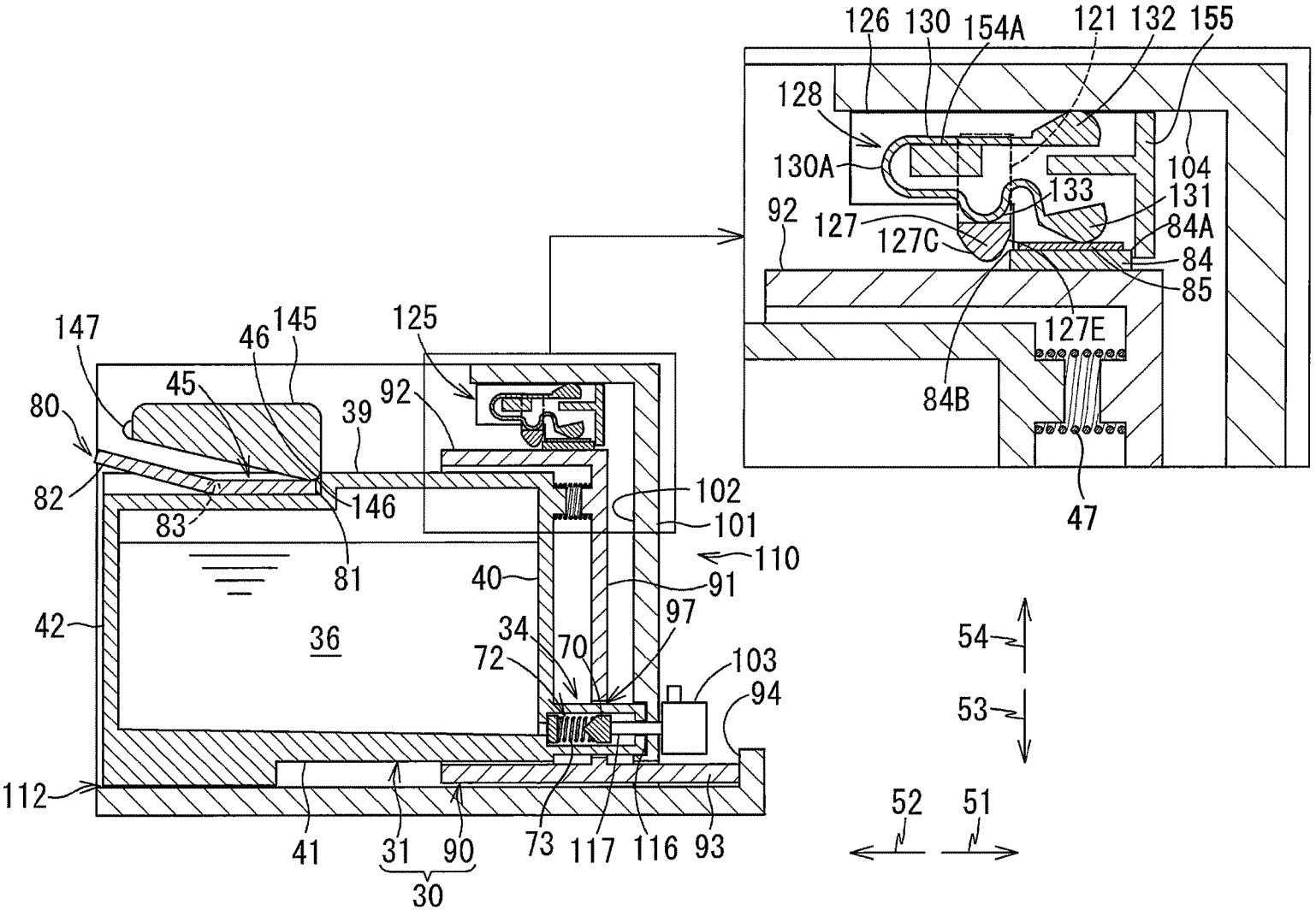
FIG. 9 is a cross-sectional view of the ink cartridge 30 and the cartridge attachment section 110 illustrating a state where the ink cartridge 30 is completely attached.

The retention groove 116 is a cylindrical-shaped groove formed in the end surface 102. The ink needle 117 is disposed at the center of the retention groove 116. As illustrated in FIG. 9, when the ink cartridge 30 is attached to the cartridge attachment section 110, the ink supply portion 34 is inserted into the retention groove 116. At this time, an outer circumferential surface of the cylindrical-shaped ink supply portion 34 contacts a cylindrical-shaped inner circumferential surface defining the retention groove 116 formed in the end surface 102. When the ink supply portion 34 is inserted into the retention groove 116, the ink needle 117 is inserted into the ink supply opening 71 of the ink supply portion 34. The ink stored in the ink chamber 36 can thus flow out therefrom. The ink flowing out from the ink chamber 36 is supplied to the recording head 21 through the ink needle 117 and the ink tube 20.

As illustrated in FIG. 4, the contacted portion 94 is provided at the case 101 on the lower side of the connecting portion 103. The contacted portion 94 has a surface that faces in the removal direction 52 (rear surface). The projection 93 of the cover 90 can contact this surface.

The engagement member 145 is provided in the case 101 to maintain the ink cartridge 30 attached to the cartridge attachment section 110 in an attached state. The engagement member 145 is capable of pivotally moving about a shaft 147 provided near the opening 112 of the case 101, for example. Specifically, the engagement member 145 is configured to pivotally move clockwise and counterclockwise in FIG. 4 about the shaft 147. The engagement member 145 has an end opposite to the shaft 147 in the insertion direction 51 and the removal direction 52 (front end), the end serving as an engagement end 146. The engagement end 146 can engage with the locking surface 46 of the ink cartridge 30. The engagement end 146 engages with the locking surface 46 when the ink cartridge 30 is completely attached to the cartridge attachment section 110 and the cover 90 is positioned at the proximity position, thereby restricting the main body 31of the ink cartridge 30 from moving in the removal direction 52 against the biasing force of the coil spring 47 and the coil spring 73. The ink cartridge 30 can be thus held in the cartridge attachment section 110.

The engagement member 145 provides a lock position (FIG. 9) where the engagement end 146 and the locking surface 46 are in engagement with each other. The engagement member 145 also provides an unlock position (FIGS. 6 through 8) where the engagement end 146 and the locking portion 45 are out of engagement with each other. The engagement member 145 can pivotally move in the downward direction 53 by its own weight. When the tip end portion 81 of the pivot member 80 is caused to pivotally move in the upward direction 54, the tip end portion 81 pushes the engagement member 145 in the upward direction 54 to cause the engagement member 145 to pivotally move in the upward direction 54 about the shaft 147. The engagement member 145 thus moves from the lock position to the unlock position.

The contact unit 125 is attached to the top surface 104 of the case 101. The contact unit 125 is provided at such a position that at least a portion thereof is disposed above the board supporting portion 84 and the IC board 85 and faces the board supporting portion 84 and the IC board 85 in a state where the ink cartridge 30 is completely attached to the cartridge attachment section 110.

<Contact Unit 125>

As illustrated in FIG. 4 and FIGS. 5A through 5C, the contact unit 125 includes a body portion 126, flexible members 128 supported at the body portion 126, and the moving wall 127 (an example of a second wall) movably supported at the body portion 126 in the upward direction 54 and the downward direction 53.

The body portion 126 has a substantially rectangular parallelepiped shape. The body portion 126 has a right side surface 118, a left side surface 119, an upper surface 151, a rear side surface 152, and a lower surface 153. The body portion 126 has notches 154 extending from the upper surface 151 to the lower surface 153 through the rear side surface 152. Four notches 154 are formed in the body portion 126 to correspond to the four electrodes 86, 87, 88, and 89 on the IC board 85 of the ink cartridge 30. The four notches 154 are arranged in the rightward direction 55 and the leftward direction 56.

The body portion 126 has two concave portions 120. One of the concave portions 120 is formed in the right side surface 118 and extends in the upward direction 54 and the downward direction 53. The other of the concave portions 120 is formed in the left side surface 119 and extends in the upward direction 54 and the downward direction 53. Each concave portion 120 has a central portion in the upward direction 54 and the downward direction 53, an upper portion above the central portion, and a lower portion below the central portion. The upper portion of the concave portion 120 has a depth in the rightward direction 55 and the leftward direction 56 greater than a depth in the rightward direction 55 and the leftward direction 56 of the lower portion of the concave portion 120. A stepped portion is thus formed in the central portion of the concave portion 120. The stepped portion has a stepped surface 120A that faces in the upward direction 54.

Four flexible members 128 are provided to correspond to the four electrodes 86, 87, 88, and 89 on the IC board 85 of the ink cartridge 30. The respective flexible members 128 are inserted into the corresponding notches 154. That is, the flexible members 128 are arranged in the rightward direction 55 and the leftward direction 56.

Each flexible member 128 is formed of an elongated electrical conductor. In the present embodiment, the flexible member 128 is made of copper whose surface is plated with nickel and gold. As illustrated in FIG. 4, the flexible member 128 includes a spring portion 130 (an example of a first biasing member) having a substantially U-shape in a side view with the opening of the "U" facing in the insertion direction 51, a first contact 131 (an example of a contact) formed at a lower end of the spring portion 130, a second contact 132 formed at an upper end of the spring portion 130, and an acting portion 133 formed between a curved portion 130A of the spring portion 130 and the first contact 131. The acting portion 133 is attached to the moving wall 127 described later. The spring portion 130, the first contact 131, the second contact 132, and the acting portion 133 are integral with each other.

The spring portion 130 has an upper portion higher than the curved portion 130A and a lower portion lower than the curved portion 130A. The upper portion of the spring portion 130 is supported on and fixed to a surface 154A of the body portion 126. The surface 154A is positioned in the notch 154 and faces in the upward direction 54. On the other hand, the lower portion of the spring portion 130 is neither supported on nor fixed to the body portion 126. The first contact 131 and the acting portion 133 formed in the lower portion of the spring portion 130 can thus move in the upward direction 54 and the downward direction 53 upon resilient deformation of the spring portion 130 of the flexible member 128.

The four first contacts 131 are provided at the same positions in the rightward direction 55 and the leftward direction 56 as the corresponding four electrodes 86, 87, 88, and 89 of the ink cartridge 30 when the ink cartridge 30 has been completely attached to the cartridge attachment section 110.

Figure 5B:
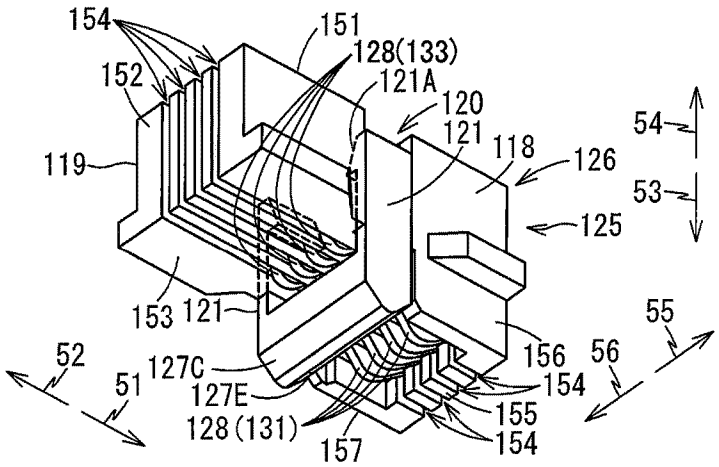
Figure 6:
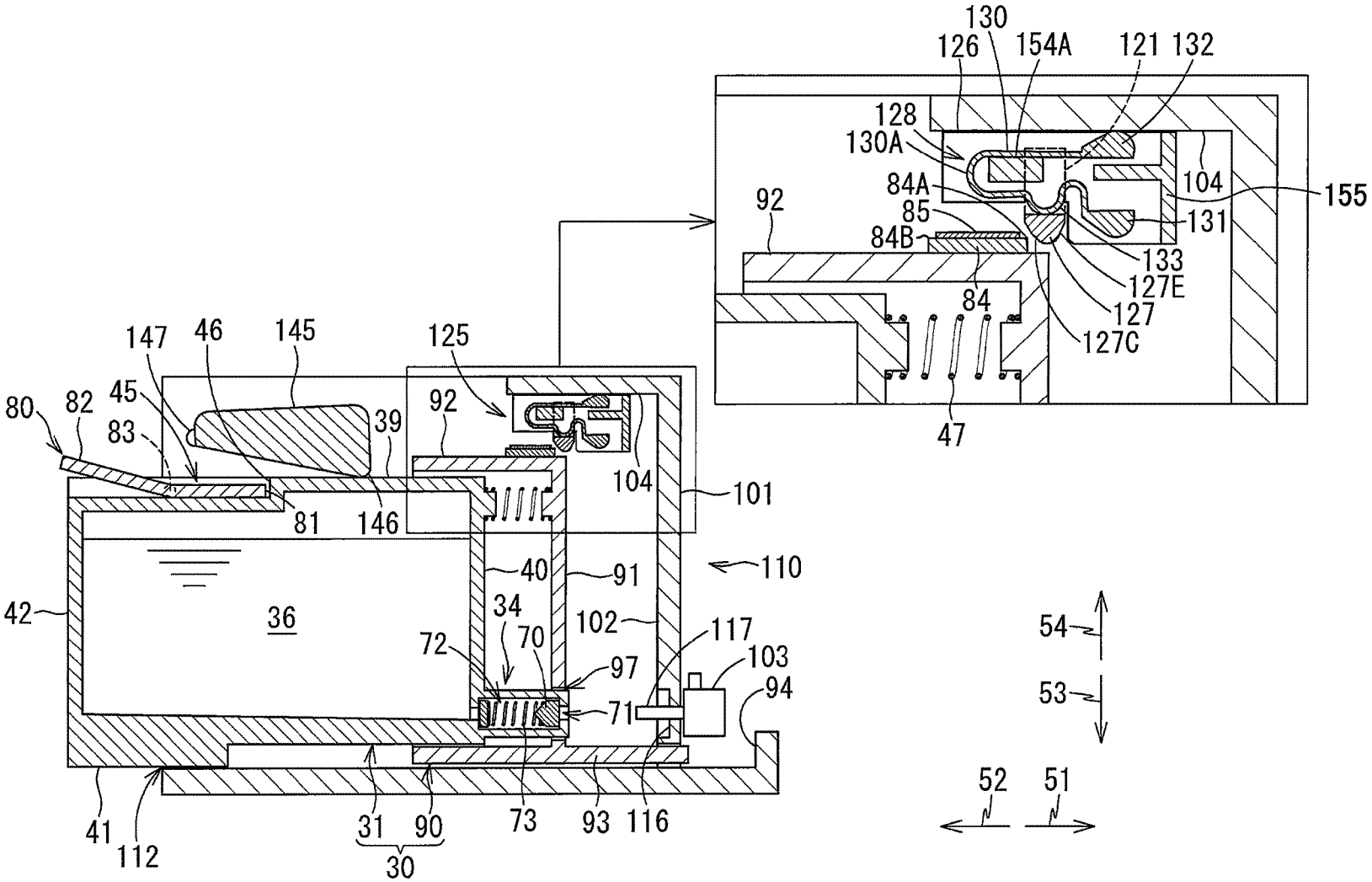
FIG. 6 is a cross-sectional view of the ink cartridge 30 and the cartridge attachment section 110 illustrating the process of attachment of the ink cartridge 30 to the cartridge attachment section 110.
Figure 7:
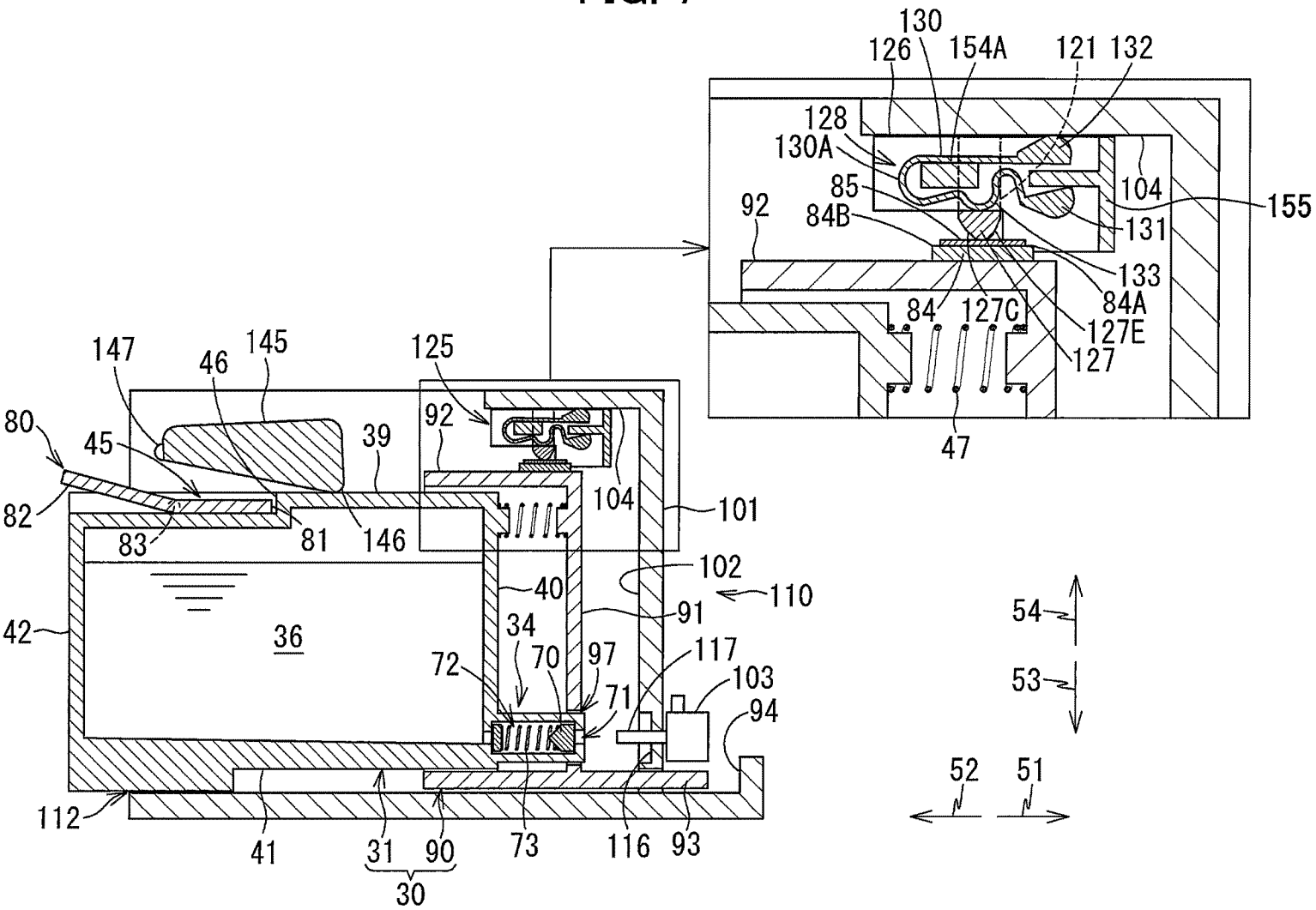
FIG. 7 is a cross-sectional view of the ink cartridge 30 and the cartridge attachment section 110 illustrating a state in which the ink cartridge 30 is inserted to a position at which an IC board 85 is disposed immediately below the moving wall 127.

Each first contact 131 can move between a contact position illustrated in FIG. 6 and a non-contact position illustrated in FIG. 7. As illustrated in FIG. 5B, the first contact 131 at the contact position has a portion positioned lower than the corresponding notch 154. More specifically, in the contact position, a lower end of the first contact 131 is positioned lower than an upper end of corresponding one of the electrodes 86, 87, 88, and 89 of the ink cartridge 30 completely attached to the cartridge attachment section 110. That is, the first contact 131 at the contact position overlaps the position of the corresponding one of the electrodes 86, 87, 88, and 89 of the ink cartridge 30 completely attached to the cartridge attachment section 110 as viewed in any directions (as viewed in any of the insertion direction 51, the removal direction 52, the downward direction 53, the upward direction 54, the rightward direction 55, the leftward direction 56). In other words, the first contact 131 at the contact position is capable of contacting the corresponding one of the electrodes 86, 87, 88, and 89.

Figure 5C:
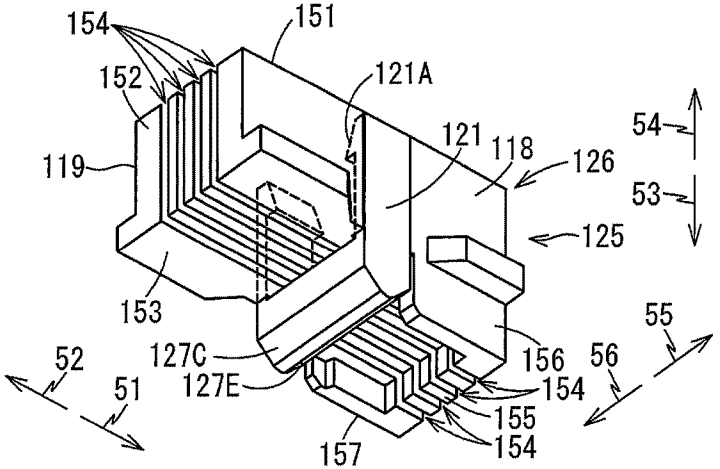

The non-contact position is higher than the contact position. That is, the non-contact position is separated in the upward direction 54 from the contact position. The first contact 131 at the non-contact position is positioned higher than the upper end of the corresponding one of the electrodes 86, 87, 88, and 89. As illustrated in FIG. 5C, the first contact 131 at the non-contact position is received in the corresponding notch 154. Thus, the first contact 131 at the non-contact position is incapable of contacting the corresponding one of the electrodes 86, 87, 88, and 89.

The second contact 132 illustrated in FIG. 4 is in contact with a contact (not illustrated) exposed through the top surface 104 of the cartridge attachment section 110. This contact at the cartridge attachment section 110 is electrically connected to the controller 1 of the printer 10 by, for example, a cable. The second contact 132 may be electrically connected to the controller 1 by, for example, a flexible flat cable (FFC), without via the contact.

The IC board 85 is electrically connected to the controller 1 via the flexible members 128 when the electrodes 86, 87, 88, and 89 contact the corresponding first contacts 131. The controller 1 can access the IC 85A formed in the IC board 85 through the contact between the electrodes 86, 87, 88, and 89 and the first contacts 131. Here, the controller 1 is a control board provided in the printer 10 and includes a CPU, a ROM, and a RAM, for example.

As illustrated in FIG. 4 and FIGS. 5A through 5C, the moving wall 127 is positioned offset in the removal direction 52 relative to the first contact 131. In other words, the moving wall 127 is positioned downstream in the removal direction 52 relative to the first contact 131. That is, the moving wall 127 is positioned rearward relative to the first contact 131.

The moving wall 127 can move in the upward direction 54 and the downward direction 53 between a first position illustrated in FIGS. 5B and 6 and a second position illustrated in FIGS. 5C and 7.

When the board supporting portion 84 and the IC board 85 contact the moving wall 127 to press the moving wall 127 upward to the second position as will be described later, a right end of the moving wall 127 is positioned further rightward than the IC board 85 and the board supporting portion 84. In other words, the right end of the moving wall 127 is positioned offset in the rightward direction 55 relative to the IC board 85 and the board supporting portion 84. Further, a left end of the moving wall 127 is positioned further leftward than the IC board 85 and the board supporting portion 84. In other words, the left end of the moving wall 127 is positioned offset in the leftward direction 56 relative to the IC board 85 and the board supporting portion 84. A length in the rightward direction 55 and the leftward direction 56 of the moving wall 127 is greater than a length in the rightward direction 55 and the leftward direction 56 of the IC board 85 and the board supporting portion 84.

The moving wall 127 has an upper surface 127A that is in contact with the acting portion 133 of each flexible member 128. The acting portion 133 may be fitted into the upper surface 127A. Still alternatively, the moving wall 127 may be attached to the acting portion 133 by an adhesive, for example. Further, although the acting portion 133 has a curved shape in the present embodiment, the acting portion 133 may have a shape other than the curved shape.

The moving wall 127 includes a pair of protruding portions 121 that protrude in the upward direction 54 from right and left ends of the upper surface 127A. Each protruding portion 121 has a projection 121A formed at a protruding end thereof. The projection 121A of one of the protruding portions 121 protrudes toward the other of the protruding portions 121.

The moving wall 127 is positioned at the first position due to its own weight when the flexible members 128 are not resiliently deformed. At this time, the projections 121A are in contact with the corresponding stepped surfaces 120A of the body portion 126 from above. The moving wall 127 is thus restricted from moving downward further than the first position.

The moving wall 127 at the first position has a portion that overlaps a trajectory of the IC board 85 and a portion of the board supporting portion 84 of the ink cartridge 30 that can be inserted into and removed from the cartridge attachment section 110.

It should be noted that the moving wall 127 may be positioned at a different position from the above-described position, as long as the moving wall 127 at the first position has the overlapping portion. For example, when the board supporting portion 84 and the IC board 85 contact the moving wall 127 to press the moving wall 127 upward to the second position as will be described later, the right end of the moving wall 127 may be positioned further rightward than the IC board 85 and the board supporting portion 84, and the left end of the moving wall 127 may be positioned between the right and left ends of the IC board 85 and the board supporting portion 84. Alternatively, the left end of the moving wall 127 may be positioned further leftward than the IC board 85 and the board supporting portion 84, and the right end of the moving wall 127 may be positioned between the right and left ends of the IC board 85 and the board supporting portion 84. Still alternatively, both the right and left ends of the moving wall 127 may be positioned between the right and left ends of the IC board 85 and the board supporting portion 84.

In the present embodiment, the "right ends of the IC board 85 and the board supporting portion 84" mean the right end of the IC board 85 and the right end of the board supporting portion 84. The "left ends of the IC board 85 and the board supporting portion 84" mean the left end of the IC board 85 and the left end of the board supporting portion 84. The "upper ends of the IC board 85 and the board supporting portion 84" mean the upper end of the IC board 85 and the upper end of the board supporting portion 84. The "lower ends of the IC board 85 and the board supporting portion 84" mean the lower end of the IC board 85 and the lower end of the board supporting portion 84. The "ends in the insertion direction 51 of the IC board 85 and the board supporting portion 84" mean the end in the insertion direction 51 of the IC board 85 and the end in the insertion direction 51 of the board supporting portion 84. The "ends in the removal direction 52 of the IC board 85 and the board supporting portion 84" mean the end in the removal direction 52 of the IC board 85 and the end in the removal direction 52 of the board supporting portion 84.

Since the moving wall 127 at the first position has a portion that overlaps the trajectory of the IC board 85 and a portion of the board supporting portion 84 of the ink cartridge 30 as described above, at least one of the IC board 85 and the board supporting portion 84 contacts a surface 127B of the moving wall 127 that faces in the removal direction 52 while the ink cartridge 30 is inserted into the cartridge attachment section 110. In the present embodiment, the first end 84A of the board supporting portion 84 contacts the surface 127B. In the present embodiment, the surface 127B has an inclined surface 127C at its lower end portion. The inclined surface 127C is inclined so as to extend diagonally in the downward direction 53 toward downstream in the insertion direction 51. In other words, the inclined surface 127C is inclined downward toward the front. That is, the inclined surface 127C has a first edge (bottom edge) and a second edge (top edge) extending in the rightward direction 55 and leftward direction 56. The first edge of the inclined surface 127C is offset in the insertion direction 51 and in the downward direction 53 relative to the second edge of the inclined surface 127C so that the inclined surface 127C forms an inclination from the first edge to the second edge. At least one of the IC board 85 and the board supporting portion 84 (the first end 84A in the present embodiment) contacts the inclined surface 127C of the surface 127B while the ink cartridge 30 is inserted into the cartridge attachment section 110.

Similarly, at least one of the IC board 85 and the board supporting portion 84 contacts a surface 127D of the moving wall 127 that faces in the insertion direction 51 while the ink cartridge 30 is removed from the cartridge attachment section 110. In the present embodiment, the second end 84B of the board supporting portion 84 contacts the surface 127D. In the present embodiment, the surface 127D has an inclined surface 127E at its lower end portion. The inclined surface 127E is inclined so as to extend diagonally in the downward direction 53 toward downstream in the removal direction 52. In other words, the inclined surface 127E is inclined downward toward the rear. That is, the inclined surface 127E has a first edge (bottom edge, an example of a third edge) and a second edge (top edge, an example of a fourth edge) extending in the rightward direction 55 and the leftward direction 56. The first edge of the inclined surface 127E is offset in the removal direction 52 and in the downward direction 53 relative to the second edge of the inclined surface 127E so that the inclined surface 127E forms an inclination from the first edge to the second edge of the inclined surface 127E . At least one of the IC board 85 and the board supporting portion 84 (the second end 84B in the present embodiment) contacts the inclined surface 127E of the surface 127D while the ink cartridge 30 is removed from the cartridge attachment section 110.

Figure 14:
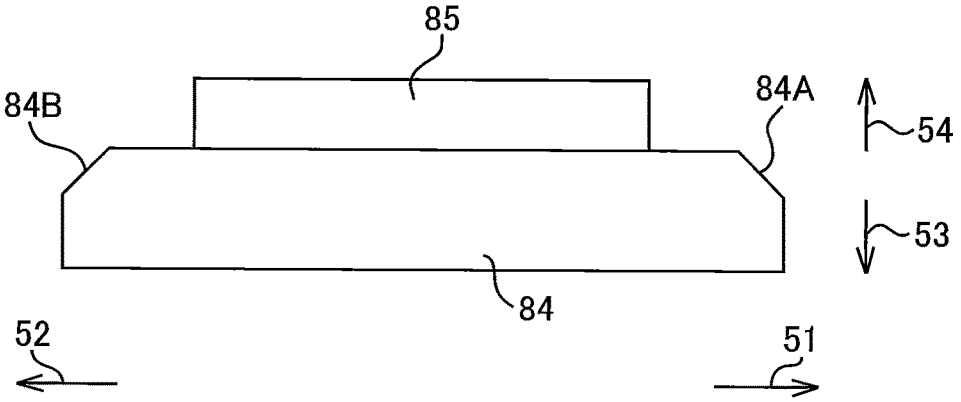
FIG. 14 is a schematic view of the IC board 85 and the board supporting portion 84 in which the board supporting portion 84 is provided with inclined surfaces at the first end 84A and the second end 84B.

An inclined surface inclined diagonally in the downward direction 53 toward downstream in the insertion direction 51 (i.e. inclined downward toward the front) may be formed at a portion of at least one of the IC board 85 and the board supporting portion 84, as illustrated in FIG. 14. At this time, the portion of at least one of the IC board 85 and the board supporting portion 84 is a portion contacting the surface 127B (the inclined surface 127C in the present embodiment) of the moving wall 127 while the ink cartridge 30 is inserted into the cartridge attachment section 110. In other words, an upper end in the insertion direction 51 of at least one of the IC board 85 and the board supporting portion 84 (i.e., the first end 84A of the board supporting portion 84 in the present embodiment, see FIG. 3) may have the inclined surface inclined diagonally in the downward direction 53 toward downstream in the insertion direction 51 (i.e. inclined downward toward the front). That is, the inclined surface formed at the portion of at least one of the IC board 85 and the board supporting portion 84 and contacting the surface 127B has a first edge (bottom edge, an example of a fifth edge) and a second edge (top edge, an example of a sixth edge) extending in the rightward direction 55 and the leftward direction 56. The first edge is positioned offset in the insertion direction 51 and in the downward direction 53 relative to the second edge so that the inclined surface forms an inclination from the first edge to the second edge. Note that, in this case, the inclined surface 127C may not necessarily be formed.

Similarly, an inclined surface inclined diagonally in the downward direction 53 toward downstream in the removal direction 52 (i.e. inclined downward toward the rear) may be formed at a portion of at least one of the IC board 85 and the board supporting portion 84, as illustrated in FIG. 14. At this time, the portion of at least one of the IC board 85 and the board supporting portion 84 is a portion contacting the surface 127D (the inclined surface 127E in the present embodiment) while the ink cartridge 30 is removed from the cartridge attachment section 110. In other words, an upper end in the removal direction 52 of at least one of the IC board 85 and the board supporting portion 84 (i.e. the second end 84B of the board supporting portion 84 in the present embodiment, see FIG. 3) may have the inclined surface inclined diagonally in the downward direction 53 toward downstream in the removal direction 52 (i.e. inclined downward toward the rear). That is, the inclined surface formed at the portion of at least one of the IC board 85 and the board supporting portion 84 and contacting the surface 127D has a first edge (bottom edge, an example of a seventh edge) and a second edge (top edge, an example of an eighth edge) extending in the rightward direction 55 and the leftward direction 56. The first edge is positioned offset in the removal direction 52 and in the downward direction 53 relative to the second edge so that the inclined surface forms an inclination from the first edge to the second edge. Note that, in this case, the inclined surface 127E may not necessarily be formed.

As illustrated in FIG. 6, when the moving wall 127 is positioned at the first position and no external force is applied to the flexible members 128, the first contacts 131 of the flexible members 128 are positioned at the contact position. That is, when the moving wall 127 is positioned at the first position, the movement of the first contacts 131 to the contact position is allowed.

When the board supporting portion 84 and the IC board 85 contact the moving wall 127 to press the moving wall 127 as will be described later, the moving wall 127 moves from the first position to the second position. When the moving wall 127 moves from the first position to the second position, the lower portion of the spring portion 130 of each flexible member 128 is resiliently deformed in the upward direction 54. Thus, a biasing force of each of the flexible members 128 in the downward direction 53 acts on the moving wall 127. That is, the flexible members 128 bias the moving wall 127 in the downward direction 53.

The moving wall 127 at the second position is positioned offset in the upward direction 54 relative to the trajectory. In other words, the moving wall 127 at the second position is positioned downstream in the upward direction 54 relative to the trajectory. That is, the moving wall 127 at the second position is positioned upward relative to the trajectory. When the moving wall 127 moves from the first position to the second position, the lower portion of the spring portion 130 of each flexible member 128 is resiliently deformed in the upward direction 54, thereby moving the first contact 131 in the upward direction 54. Hence, when the moving wall 127 is positioned at the second position, the first contacts 131 are positioned at the non-contact position.

Figure 5A:
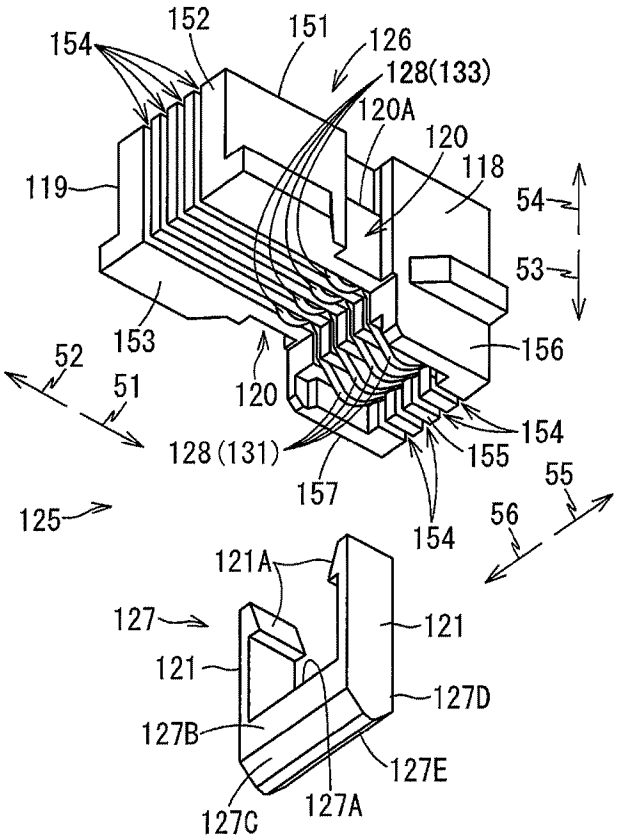

As illustrated in FIGS. 5A through 5C, the body portion 126 has the front wall 155 (an example of a first wall), the right side wall 156 (an example of a third wall), and the left side wall 157 (an example of a fourth wall).

The front wall 155 is positioned offset in the insertion direction 51 relative to the first contacts 131. In other words, the front wall 155 is positioned downstream in the insertion direction 51 relative to the first contacts 131. That is, the front wall 155 is positioned frontward relative to the first contacts 131. A right end of the front wall 155 is positioned further rightward than the IC board 85 and the board supporting portion 84 of the ink cartridge 30 that is completely attached to the cartridge attachment section 110. That is, the right end of the front wall 155 is positioned offset in the rightward direction 55 relative to the IC board 85 and the board supporting portion 84 of the ink cartridge 30 that is completely attached to the cartridge attachment section 110. A left end of the front wall 155 is positioned further leftward than the IC board 85 and the board supporting portion 84 of the ink cartridge 30 that is completely attached to the cartridge attachment section 110. That is, the left end of the front wall 155 is positioned offset in the leftward direction 56 relative to the IC board 85 and the board supporting portion 84 of the ink cartridge 30 that is completely attached to the cartridge attachment section 110.

The front wall 155 has a portion that is positioned lower than the upper ends of the IC board 85 and the board supporting portion 84 of the ink cartridge 30 that is completely attached to the cartridge attachment section 110 and also positioned higher than the lower ends of the IC board 85 and the board supporting portion 84 of the ink cartridge 30 that is completely attached to the cartridge attachment section 110. In other words, the front wall 155 has a portion that overlaps the IC board 85 and a portion of the board supporting portion 84 of the ink cartridge 30 that is completely attached to the cartridge attachment section 110 when viewed in the insertion direction 51. Here, the overlapping portion is a portion of the front wall 155 positioned between the upper and lower ends of the IC board 85 and the board supporting portion 84 and also positioned between the right and left ends of the IC board 85 and the board supporting portion 84.

It should be noted that the front wall 155 may be positioned at a different position from the above-described position, as long as the front wall 155 has the overlapping portion. For example, when the ink cartridge 30 is attached to the cartridge attachment section 110, the right end of the front wall 155 may be positioned further rightward than the IC board 85 and the board supporting portion 84, and the left end of the front wall 155 may be positioned between the right and left ends of the IC board 85 and the board supporting portion 84. Alternatively, the left end of the front wall 155 may be positioned further leftward than the IC board 85 and the board supporting portion 84, and the right end of the front wall 155 may be positioned between the right and left ends of the IC board 85 and the board supporting portion 84. Still alternatively, both the right and left ends of the front wall 155 may be positioned between the right and left ends of the IC board 85 and the board supporting portion 84.

The right side wall 156 is disposed rightward of the first contacts 131. That is, the right side wall 156 is positioned offset in the rightward direction 55 relative to the first contacts 131. In other words, the right side wall 156 is positioned downstream in the rightward direction 55 relative to the first contacts 131. An end in the insertion direction 51 of the right side wall 156 (front end) is positioned offset in the insertion direction 51 relative to the IC board 85 of the ink cartridge 30 that is completely attached to the cartridge attachment section 110. That is, the front end of the right side wall 156 is positioned frontward relative to the IC board 85 of the ink cartridge 30 that is completely attached to the cartridge attachment section 110. An end in the removal direction 52 of the right side wall 156 (rear end) is positioned offset in the removal direction 52 relative to the IC board 85 of the ink cartridge 30 that is completely attached to the cartridge attachment section 110. The rear end of the right side wall 156 is positioned downstream in the removal direction 52 relative to the IC board 85 of the ink cartridge 30 that is completely attached to the cartridge attachment section 110. That is, the rear end of the right side wall 156 is positioned rearward of the IC board 85 of the ink cartridge 30 that is completely attached to the cartridge attachment section 110.

The right side wall 156 has a portion that is positioned lower than the upper end of the IC board 85 of the ink cartridge 30 that is completely attached to the cartridge attachment section 110 and also positioned higher than the lower end of the IC board 85 of the ink cartridge 30 that is completely attached to the cartridge attachment section 110. In other words, the right side wall 156 has a portion that overlaps the IC board 85 of the ink cartridge 30 that is completely attached to the cartridge attachment section 110 when viewed in the rightward direction 55. Here, the overlapping portion is a portion of the right side wall 156 positioned between the upper and lower ends of the IC board 85 and also positioned between both ends in the insertion direction 51 and the removal direction 52 of the IC board 85.

It should be noted that the right side wall 156 may be positioned at a different position form the above-described position, as long as the right side wall 156 has the overlapping portion. For example, when the ink cartridge 30 is attached to the cartridge attachment section 110, the end in the insertion direction 51 of the right side wall 156 may be positioned offset in the insertion direction 51 relative to the IC board 85, and the end in the removal direction 52 of the right side wall 156 may be positioned between both ends in the insertion direction 51 and the removal direction 52 of the IC board 85. Alternatively, the end in the removal direction 52 of the right side wall 156 may be positioned offset in the removal direction 52 relative to the IC board 85, and the end in the insertion direction 51 of the right side wall 156 may be positioned between both ends in the insertion direction 51 and the removal direction 52 of the IC board 85. Still alternatively, both ends in the insertion direction 51 and the removal direction 52 of the right side wall 156 may be positioned between both ends in the insertion direction 51 and the removal direction 52 of the IC board 85.

The left side wall 157 is disposed leftward of the first contacts 131. That is, the left side wall 157 is positioned offset in the leftward direction 56 relative to the first contacts 131. In other words, the left side wall 157 is positioned downstream in the leftward direction 56 relative to the first contacts 131. The left side wall 157 has a portion that overlaps the IC board 85 of the ink cartridge 30 that is completely attached to the cartridge attachment section 110 when viewed in the leftward direction 56. Here, the overlapping portion is a portion of the left side wall 157 positioned lower than the upper end of the IC board 85 of the ink cartridge 30 that is completely attached to the cartridge attachment section 110 and also positioned higher than the lower end of the IC board 85 of the ink cartridge 30 that is completely attached to the cartridge attachment section 110. The overlapping portion is also a portion of the left side wall 157 positioned between both ends in the insertion direction 51 and the removal direction 52 of the IC board 85. The position and configuration of the left side wall 157 are the same as those of the right side wall 156, and the detailed description thereof will be omitted.

A separation distance between the right side wall 156 and the left side wall 157 in the rightward direction 55 and the leftward direction 56 is set to such a length that the board supporting portion 84 and the IC board 85 can be positioned between the right side wall 156 and the left side wall 157. That is, this separation distance is larger than the length in the rightward direction 55 and the leftward direction 56 of the board supporting portion 84. That is, the separation distance is larger than the length between the right and left ends of the protruding ends of the board supporting portion 84 and the IC board 85 protruding from the top wall 92 of the cover 90.

<Operation for Attaching and Detaching Ink Cartridge 30>

Hereinafter, an operation for attaching and detaching the ink cartridge 30 relative to the cartridge attachment section 110 will be described with reference to FIGS. 6 through 9.

As illustrated in FIG. 6, when the ink cartridge 30 is inserted into the cartridge attachment section 110 in the insertion direction 51, the engagement member 145 is pivotally moved in the upward direction 54 by the top wall 92 of the cover 90 and the top wall 39 of the main body 31. The engagement member 145 is therefore moved from the lock position to the unlock position. At this time, the moving wall 127 is positioned at the first position and the first contacts 131 are positioned at the contact position.

When the ink cartridge 30 is inserted further in the insertion direction 51, the first end 84A of the board supporting portion 84 contacts the inclined surface 127C of the moving wall 127. The moving wall 127 is guided by the inclined surface 127C and rides up on the upper surfaces of the board supporting portion 84 and the IC board 85. That is, the moving wall 127 moves in the upward direction 54 from the first position to the second position (see FIG. 7).

When the moving wall 127 moves from the first position to the second position, the spring portions 130 of the flexible members 128 are resiliently deformed. As a result, the first contacts 131 move in the upward direction 54 from the contact position to the non-contact position (see FIG. 7).

Figure 8:
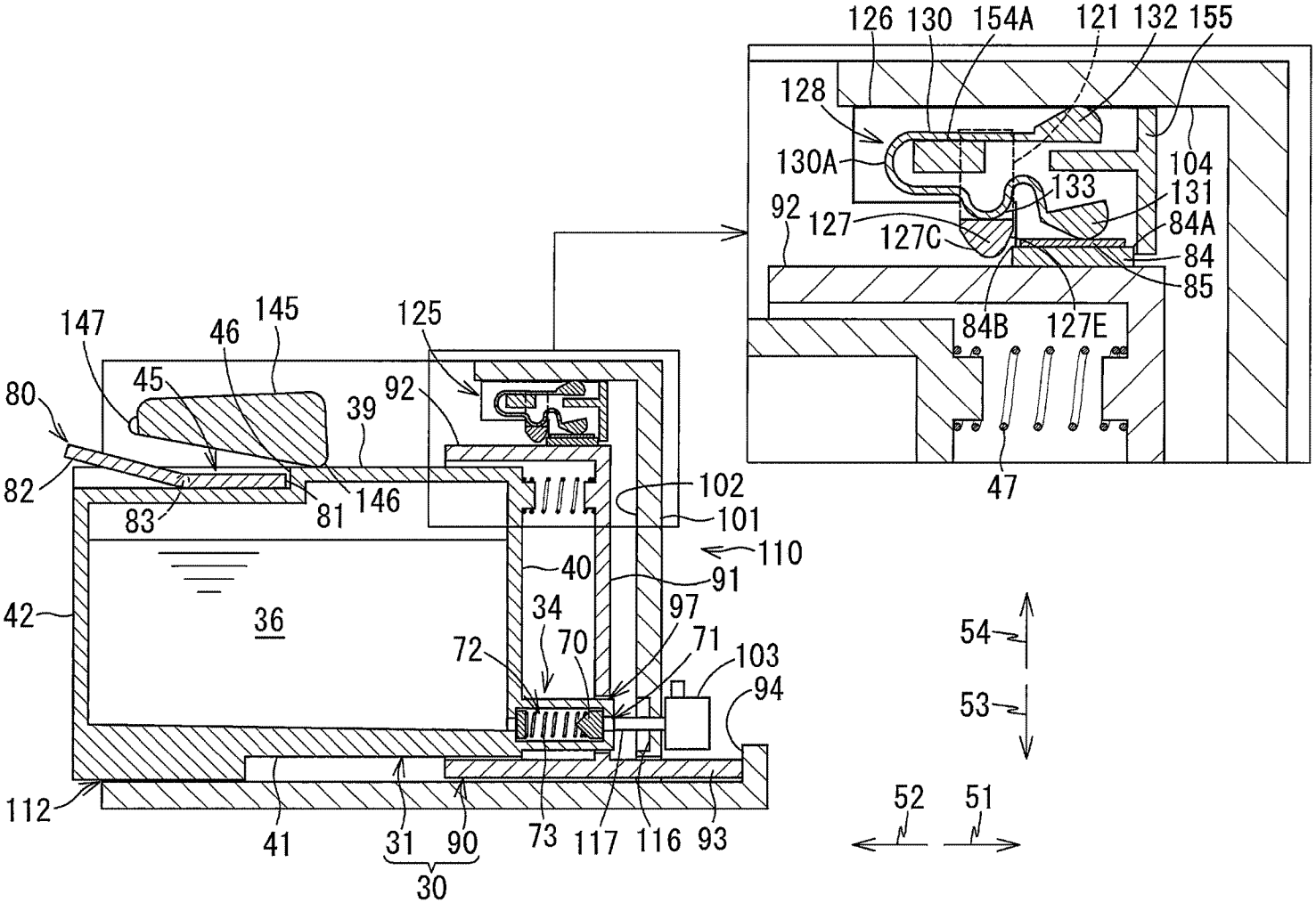
FIG. 8 is a cross-sectional view of the ink cartridge 30 and the cartridge attachment section 110 illustrating a state where the ink cartridge 30 is inserted to a position at which the IC board 85 is disposed immediately below a first contact 131.

When the ink cartridge 30 is inserted further in the insertion direction 51 from the state illustrated in FIG. 7, the board supporting portion 84 and the IC board 85 are separated from the moving wall 127. At this time, the moving wall 127 moves in the downward direction 53 from the second position to the first position by the biasing force of the spring portions 130 as illustrated in FIG. 8. Hence, the first contacts 131 move in the downward direction 53 from the non-contact position to the contact position. As a result, the first contacts 131 are in contact with the corresponding electrodes 86, 87, 88, and 89 on the IC board 85 from above. At this time, the front wall 155 is disposed in the first space 161, the moving wall 127 at the first position is disposed in the second space 162, the right side wall 156 is disposed in the third space 163, and the left side wall 157 is disposed in the fourth space 164. Hence, the board supporting portion 84 and the IC board 85 are positioned between the moving wall 127 at the first position and the front wall 155 in the insertion direction 51 and the removal direction 52. Further, the board supporting portion 84 and the IC board 85 are positioned between the right side wall 156 and the left side wall 157 in the rightward direction 55 and the leftward direction 56.

At this time, the projection 93 of the cover 90 contacts the contacted portion 94. As a result, the cover 90 cannot move further in the insertion direction 51. Thus, when the ink cartridge 30 is inserted further in the insertion direction 51 from the state illustrated in FIG. 8, the cover 90 does not move, but the main body 31 moves in the insertion direction 51 against the biasing force of the coil spring 47.

When the ink cartridge 30 is inserted further in the insertion direction 51 from the state illustrated in FIG. 8, the ink supply portion 34 contacts the retention groove 116. Thus, as illustrated in FIG. 9, the ink needle 117 is inserted into the ink supply opening 71 of the ink supply portion 34. The ink supply valve 70 is pressed by the ink needle 117 and is separated from the ink supply opening 71 against the biasing force of the coil spring 73.

Further, the engagement member 145 reaches the locking portion 45 of the main body 31 of the ink cartridge 30. Since the engagement member 145 is no longer supported by the top wall 39 of the main body 31, the engagement member 145 is pivotally moved in the downward direction 53 to be positioned at the lock position. At this time, the engagement end 146 and the locking surface 46 face each other in the insertion direction 51 and the removal direction 52.

When the force pressing the ink cartridge 30 in the insertion direction 51 disappears from this state, the ink cartridge 30 retracts in the removal direction 52 to a position where the engagement end 146 and the locking surface 46 contacts each other due to the biasing forces of the coil spring 47 and the coil spring 73. As a result, the engagement member 145 allows the ink cartridge 30 to be retained in the cartridge attachment section 110 against the force pressing the ink cartridge 30 in the removal direction 52 (i.e. the biasing forces of the coil spring 47 and the coil spring 73). At this time, the tip end portion 81 of the pivot member 80 is positioned below the engagement member 145. Further, the rear end portion 82 of the pivot member 80 is separated from the bottom surface of the groove constituting the locking portion 45 and is positioned higher than the top wall 39 of the main body 31. In this way, the attachment of the ink cartridge 30 to the cartridge attachment section 110 is completed.

When the ink cartridge 30 has been completely attached to the cartridge attachment section 110 as illustrated in FIG. 9, the ink needle 117 keeps the ink supply valve 70 separated from the ink supply opening 71. Hence, ink can flow out from the ink chamber 36 through an ink inlet (not illustrated) formed at the distal end of the ink needle 117. Further, the electrodes 86, 87, 88, and 89 are in contact with the corresponding first contacts 131, thereby establishing electrical connection between the IC 85A of the IC board 85 and the controller 1 of the printer 10. The controller 1 can thus access the IC 85A of the IC board 85.

For removing the ink cartridge 30 from the cartridge attachment section 110, the user presses the rear end portion 82 of the pivot member 80 in the downward direction 53. The tip end portion 81 of the pivot member 80 in turn moves in the upward direction 54 to be separated from the bottom surface of the groove constituting the locking portion 45. In accordance with this upward movement of the tip end portion 81, the engagement member 145 is caused to pivotally move in the upward direction 54. Thus, the engagement member 145 moves from the lock position to the unlock position. The engagement member 145 no longer retains the ink cartridge 30 in the cartridge attachment section 110.

When the engagement member 145 is moved to the unlock position, the ink cartridge 30 moves in the removal direction 52 by the biasing forces of the coil spring 47 and the coil spring 73. Further, when the ink cartridge 30 is moved in the removal direction 52, the ink needle 117 is removed from the ink supply portion 34. As a result, the ink supply valve 70 is pressed toward the ink supply opening 71 by a restoring force of the coil spring 73 to block the ink supply opening 71.

Further, when the ink cartridge 30 is moved in the removal direction 52, the second end 84B of the board supporting portion 84 contacts the inclined surface 127E of the moving wall 127. The moving wall 127 is guided by the inclined surface 127E and rides up on the upper surfaces of the board supporting portion 84 and the IC board 85. That is, the moving wall 127 moves in the upward direction 54 from the first position to the second position.

When the moving wall 127 moves from the first position to the second position, the spring portions 130 of the flexible members 128 are resiliently deformed. As a result, the first contacts 131 move in the upward direction 54 from the contact position to the non-contact position.

When the ink cartridge 30 moves further in the removal direction 52, the board supporting portion 84 and the IC board 85 are positioned offset in the removal direction 52 relative to the moving wall 127. At this time, the moving wall 127 moves in the downward direction 53 from the second position to the first position by the biasing force of the spring portions 130. Hence, the first contacts 131 move in the downward direction 53 from the non-contact position to the contact position (see FIG. 6). In this way, the electrodes 86, 87, 88, and 89 are separated from the corresponding first contacts 131, and the electrical connection between the IC 85A of the IC board 85 and the controller 1 of the printer 10 is disconnected.

<Operational and Technical Advantages>

In the present embodiment, when inserted into and removed from the cartridge attachment section 110, the ink cartridge 30 moves the moving wall 127 at the first position and on the trajectory of the IC board 85 to the second position against the biasing force of the spring portions 130. Further, when the ink cartridge 30 has been completely attached to the cartridge attachment section 110, the front wall 155 is accommodated in the first space 161 and the moving wall 127 at the first position is accommodated in the second space 162. In other words, the IC board 85 of the completely attached ink cartridge 30 is disposed between the front wall 155 and the moving wall 127 at the first position in the insertion direction 51 and the removal direction 52. Hence, the electrodes 86, 87, 88, and 89 mounted on the IC board 85 contacts the first contacts 131 that have been moved to the contact position by the moving wall 127 at the first position.

Figure 11A:
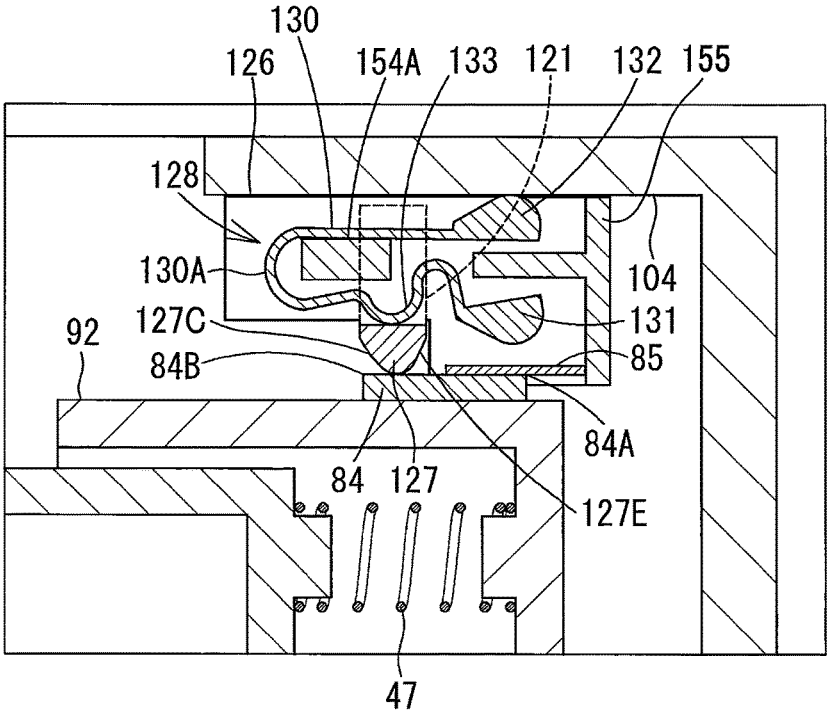
Figure 11B:
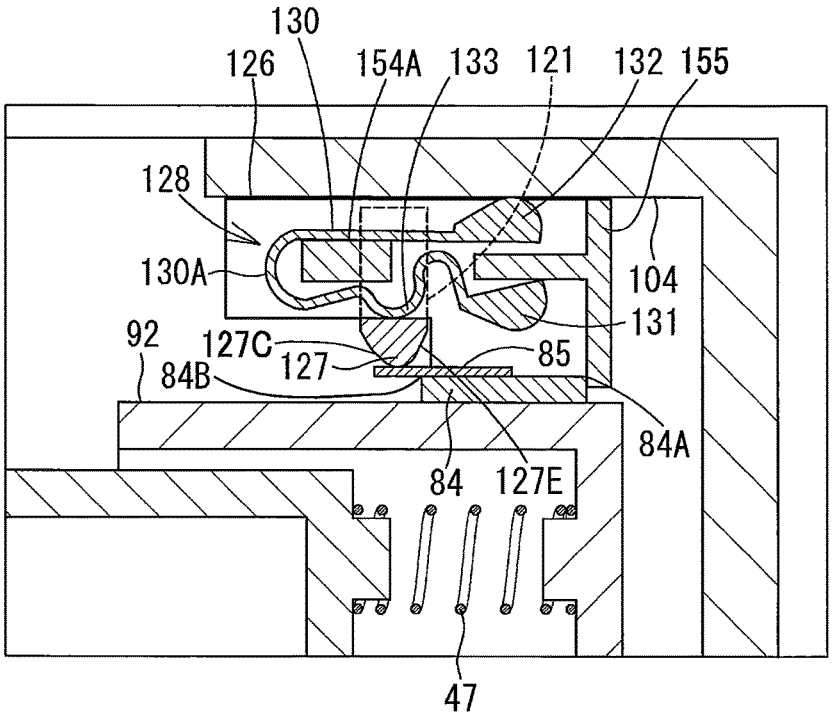
Figure 12A:
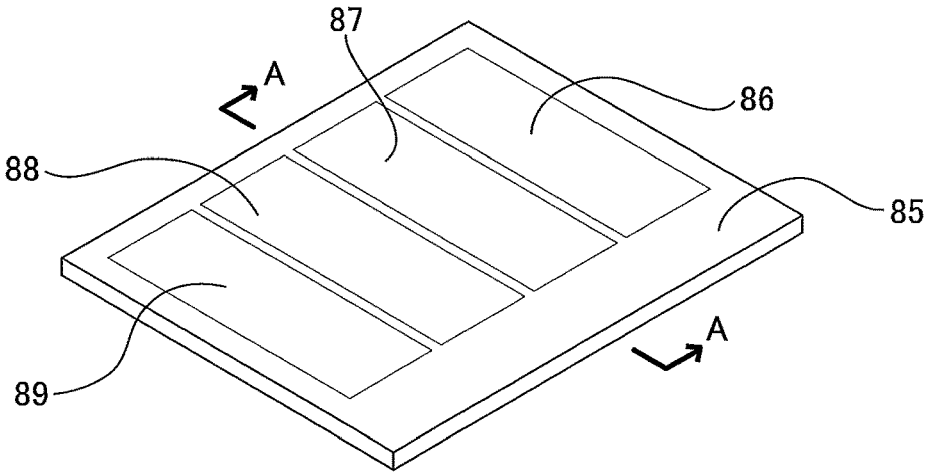
Figure 12B:
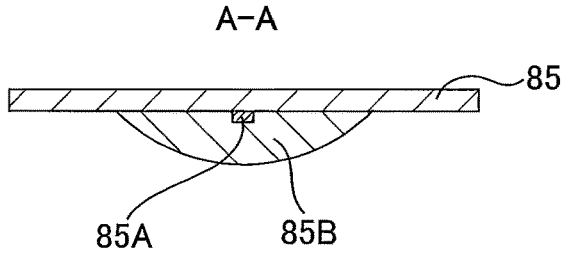
Figure 12C:
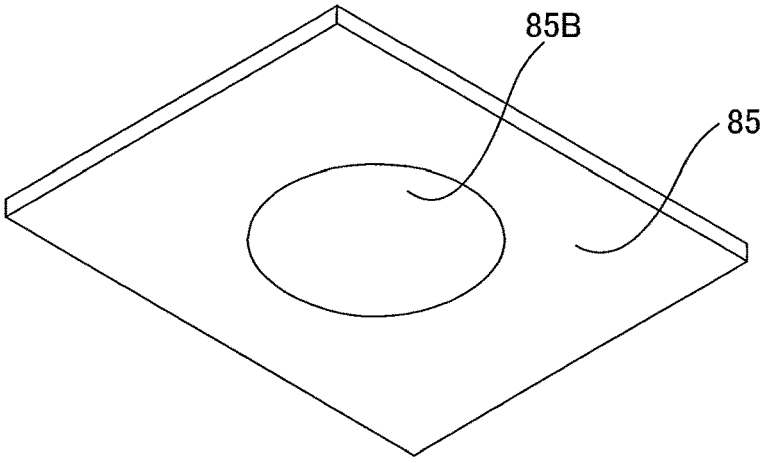

As illustrated in FIG. 11A, if the IC board 85 were disposed offset in the insertion direction 51 relative to the board supporting portion 84, it is likely that, when the ink cartridge 30 has been completely attached to the cartridge attachment section 110, the IC board 85 would contact the front wall 155 and the board supporting portion 84 would protrude into the second space 162 to inhibit the moving wall 127 from moving to the first position. Similarly, as illustrated in FIG. 11B, if the IC board 85 were disposed offset in the removal direction 52 relative to the board supporting portion 84, it is likely that, when the ink cartridge 30 has been completely attached to the cartridge attachment section 110, the IC board 85 would protrude into the second space 162 to inhibit the moving wall 127 from moving to the first position. If the moving wall 127 cannot move to the first position, the first contacts 131 cannot move to the contact position. As a result, the electrodes 86, 87, 88, and 89 cannot contact the first contacts 131. In other words, the electrodes 86, 87, 88, and 89 of the IC board 85 can contact the first contacts 131 only when the IC board 85 is supported by the board supporting portion 84 at the correct position. Put another way, the electrodes 86, 87, 88, and 89 of the IC board 85 cannot contact the first contacts 131 if the IC board 85 is supported by the board supporting portion 84 in a state where the IC board 85 is displaced in the insertion direction 51 or the removal direction 52 relative to the board supporting portion 84. The structure of the present embodiment can ensure stable electrical contact between the electrodes 86, 87, 88, and 89 and the first contacts 131.

Here, "the ink cartridge 30 is (or has been) completely attached to the cartridge attachment section 110" implies a state where the recording head 21 can consume ink stored in the ink cartridge 30, for example. Further, in the course of insertion and removal of the ink cartridge 30 relative to the cartridge attachment section 110, either the IC board 85 or the board supporting portion 84 may contact the moving wall 127, or any other component of the ink cartridge 30 may contact the moving wall 127.

Further, according to the present embodiment, in the course of insertion and removal of the ink cartridge 30 relative to the cartridge attachment section 110, the moving wall 127 at the first position can move smoothly to the second position along the inclined surfaces 127C and 127E. That is, the ink cartridge 30 can be inserted into and removed from the cartridge attachment section 110 smoothly.

Further, according to the present embodiment, if the IC board 85 were supported by the board supporting portion 84 at a position offset in the rightward direction 55 relative to the board supporting portion 84, the IC board 85 would contact the right side wall 156 to inhibit insertion of the ink cartridge 30 into the cartridge attachment section 110. Similarly, if the IC board 85 were supported by the board supporting portion 84 at a position offset in the leftward direction 56 relative to the board supporting portion 84, the IC board 85 would contact the left side wall 157 to inhibit insertion of the ink cartridge 30 into the cartridge attachment section 110. Hence, the electrodes 86, 87, 88, and 89 of the IC board 85 can contact the first contacts 131 only when the IC board 85 is supported by the board supporting portion 84 at the correct position. The electrodes 86, 87, 88, and 89 of the IC board 85 cannot contact the first contacts 131 if the IC board 85 were supported by the board supporting portion 84 at a position offset in the rightward direction 55 or in the leftward direction 56 relative to the board supporting portion 84. The structure of the present embodiment can thus realize stable electrical contact between the electrodes 86, 87, 88, and 89 and the first contacts 131.

Further, according to the present embodiment, the board supporting portion 84 extends in the insertion direction 51 and the removal direction 52 to protrude further than the IC board 85 in the insertion direction 51 and the removal direction 52. Therefore, the IC board 85 can be prevented from colliding against the moving wall 127 at the first position even if the ink cartridge 30 is inserted into and removed from the cartridge attachment section 110 strongly, for example. Accordingly, the IC board 85 can be suppressed from being removed from the board supporting portion 84. Incidentally, the IC board 85 may contact the moving wall 127 after the board supporting portion 84 contacts the moving wall 127, since the momentum of the ink cartridge 30 can be reduced when the board supporting portion 84 contacts the moving wall 127.

Further, according to the present embodiment, the cover 90 is biased in the insertion direction 51 by the coil spring 47 when the ink cartridge 30 has been completely attached to the cartridge attachment section 110. This prevents the IC board 85 and the board supporting portion 84 from moving in the removal direction 52 unexpectedly. Hence, the moving wall 127 at the first position can be prevented from moving to the second position. If mechanical degradation or fatigue of the case 101, the engagement member 145, or the shaft 147 over time, for example, causes positional displacement of the engagement member 145 relative to the locking surface 46, the main body 31 of the ink cartridge 30 completely attached to the cartridge attachment section 110 may be unexpectedly displaced in the removal direction 52.

However, since the coil spring 47 biases the cover 90 in the insertion direction 51, the position of the cover 90 does not change. The structure of the present embodiment can ensure stable electrical contact between the electrodes 86, 87, 88, and 89 and the first contacts 131.

The controller 1 according to the present embodiment can access the IC 85A of the ink cartridge 30 through the electrodes 86, 87, 88, and 89 and the first contacts 131 that are in stable contact with each other. Here, "access" implies one of or both of retrieving information from the IC 85A and writing information to the IC 85A, for example.

<Modifications and Variations>

In the above-described embodiment, the first contacts 131 are integral with the respective spring portions 130 that bias the moving wall 127. However, the first contacts 131 may be formed as separate members from the respective spring portions 130. In this case, for example, the contact unit 125 may include an interlocking mechanism that allows the first contacts 131 to move from the contact position to the non-contact position in interlocking relation to the movement of the moving wall 127 from the first position to the second position and that allows the first contacts 131 to move from the non-contact position to the contact position in interlocking relation to the movement of the moving wall 127 from the second position to the first position. When the first contacts 131 are formed as members separately from the respective spring portions 130, the first contacts 131 are electrically connected to the respective second contacts 132 through an FFC, for example.

Further, in the above-described embodiment, the board supporting portion 84 protrudes from the top wall 92 to form the first space 161, the second space 162, the third space 163 and the fourth space 164. However, a concave portion may be formed in the top wall 92 at a portion surrounding the board supporting portion 84 to provide the first space 161, the second space 162, the third space 163 and the fourth space 164.

Further, in the above-described embodiment, although the ink cartridge 30 includes the main body 31, the cover 90, and the coil spring 47. However, the ink cartridge 30 may not include the cover 90 or the coil spring 47. In this case, the board supporting portion 84 is disposed on the upper surface of the top wall 39 of the main body 31.

In the above-described embodiment, the printer 10 configured to record images on recording sheets based on an inkjet recording scheme is described as an example of a system. However, the system may be a printer configured to record images on recording sheets based on another scheme, such as an electrophotographic scheme, or may be a label printer configured to record images on labels based on a thermal transfer printing scheme.

In the above-described embodiment, ink is employed as an example of a consumable material. However, instead of liquid such as ink, the consumable material may be a powder such as toner, or a tape used in a label printer, for example.

While the description has been made in detail with reference to the embodiment thereof, it would be apparent to those skilled in the art that various changes and modifications may be made therein without departing from the spirit of the above-described embodiment.

What is claimed is:

1. A system comprising:

a cartridge configured to accommodate a consumable material;

an attachment section into which the cartridge is inserted in a first direction to be attached thereto and from which the cartridge is removed in a second direction opposite to the first direction; and a consuming section including a recording head and configured to consume the consumable material accommodated in the cartridge upon completion of attachment of the cartridge to the attachment section, the cartridge comprising:

a board supporting portion;

a board supported at the board supporting portion and having a surface facing in a third direction that is orthogonal to the first direction and the second direction; and an electrical interface mounted on the surface of the board, the attachment section comprising:

a contact configured to move between a contact position and a non-contact position separating from the contact position in the third direction, the contact at the contact position overlapping the electrical interface of the cartridge in a state where the cartridge is completely attached to the attachment section;

a first wall positioned offset relative to the contact in the first direction, the first wall having a portion overlapping the board and a part of the board supporting portion of the cartridge as viewed in the first direction in a state where the cartridge is completely attached to the attachment section;

a second wall positioned offset relative to the contact in the second direction, the second wall being configured to move in the third direction and a fourth direction opposite to the third direction; and a first biasing member configured to bias the second wall in the fourth direction, wherein the second wall is configured to move between a first position and a second position, the second wall at the first position having a portion overlapping a trajectory of the board and a part of the board supporting portion of the cartridge that is inserted into and removed from the attachment section, the second wall at the first position allowing the contact to be moved to the contact position, the second wall at the second position being positioned offset relative to the trajectory in the third direction, the second wall at the second position placing the contact at the non-contact position, and wherein, in a state where the cartridge is completely attached to the attachment section, the cartridge provides a first space receiving the first wall and a second space receiving the second wall at the first position, the first space being formed in a region offset relative to the board and a part of the board supporting portion in the first direction, the second space being formed in a region offset relative to the board and a part of the board supporting portion in the second direction.

2. The system according to claim 1, wherein the second wall has a first surface contacting at least one of the board and the board supporting portion while the cartridge is being inserted into the attachment section, and a second surface contacting at least one of the board and the board supporting portion while the cartridge is being removed from the attachment section, the first surface having a first edge and a second edge extending in a fifth direction that is orthogonal to the first direction, the second direction, the third direction, and the fourth direction, the second surface having a third edge and a fourth edge extending in the fifth direction, wherein at least one of the board and the board supporting portion has a third surface contacting the second wall while the cartridge is being inserted into the attachment section, and a fourth surface contacting the second wall while the cartridge is being removed from the attachment section, the third surface having a fifth edge and a sixth edge extending in the fifth direction, the fourth surface having a seventh edge and an eighth edge extending in the fifth direction, wherein at least one of the first surface and the third surface is an inclined surface such that the first edge is positioned offset in the first direction and the fourth direction relative to the second edge and that the fifth edge is positioned offset in the first direction and the fourth direction relative to the sixth edge, and wherein at least one of the second surface and the fourth surface is an inclined surface such that the third edge is positioned offset in the second direction and the fourth direction relative to the fourth edge and that the seventh edge is positioned offset in the second direction and the fourth direction relative to the eighth edge.

3. The system according to claim 1, wherein the attachment section further comprises:

a third wall positioned offset relative to the contact in a fifth direction that is orthogonal to the first direction, the second direction, the third direction and the fourth direction, the third wall having a portion overlapping the board of the cartridge as viewed in the fifth direction in a state where the cartridge is completely attached to the attachment section; and a fourth wall positioned offset relative to the contact in a sixth direction opposite to the fifth direction, the fourth wall having a portion overlapping the board of the cartridge as viewed in the sixth direction in a state where the cartridge is completely attached to the attachment section, and wherein, in a state where the cartridge is completely attached to the attachment section, the cartridge further provides a third space receiving the third wall and a fourth space receiving the fourth wall, the third space being formed in a region offset relative to the board in the fifth direction, the fourth space being formed in a region offset relative to the board in the sixth direction.

4. The system according to claim 1, wherein the board supporting portion has a first end extending further than the board in the first direction, and a second end extending further than the board in the second direction, the first end contacting the second wall at the first position while the cartridge is being inserted into the attachment section, the second end contacting the second wall at the first position while the cartridge is being removed from the attachment section.

5. The system according to claim 1, wherein the cartridge further comprises:

a main body configured to accommodate the consumable material;

a movable member at which the board supporting portion is provided, the movable member being configured to move relative to the main body in the first direction and in the second direction between a proximal position and a remote position farther from the main body than in the proximal position, the movable member being at the proximity position in a state where the cartridge is completely attached to the attachment section; and a second biasing member configured to bias the movable member away from the main body in the first direction, and wherein the attachment section includes a lock portion configured to restrict the main body from moving in the second direction against the biasing force of the second biasing member in a state where the cartridge is completely attached to the attachment section.

6. The system according to claim 1, wherein the cartridge includes an integrated circuit that is capable of storing information on the consumable material, and the system further comprising a controller configured to access the integrated circuit through the electrical interface contacted by the contact.

7. The system according to claim 1, wherein the first wall is separated from the second wall by a first distance in the first direction, wherein the cartridge includes a casing constituting an outer shape thereof, the board supporting portion protruding in the third direction from the casing, and wherein the board and the board supporting portion in combination has a first protruding end in the first direction and a second protruding end in the second direction, the first protruding end and the second protruding end defining a second distance therebetween, the second distance being smaller than a first distance.

8. The system according to claim 1, wherein the contact is integral with the first biasing member.

9. The system according to claim 1, wherein the third direction is a vertically upward direction and the fourth direction is a vertically downward direction.

* * * * *